US010786080B1

(12) United States Patent
Stravitz et al.

(10) Patent No.: US 10,786,080 B1
(45) Date of Patent: Sep. 29, 2020

(54) ANTI-TIPPING MECHANISMS INTEGRATED INTO FURNITURE

(71) Applicant: Dooli Products, LLC, New York, NY (US)

(72) Inventors: David M Stravitz, New York, NY (US); Steven G Marton, New York, NY (US)

(73) Assignee: Dooli Products, LLC, New York, NY (US)

( * ) Notice: Subject to any disclaimer, the term of this patent is extended or adjusted under 35 U.S.C. 154(b) by 0 days.

(21) Appl. No.: 16/799,941

(22) Filed: Feb. 25, 2020

Related U.S. Application Data

(60) Provisional application No. 62/949,664, filed on Dec. 18, 2019, provisional application No. 62/944,425, filed on Dec. 6, 2019.

(51) Int. Cl.
*A47B 67/04* (2006.01)
*A47B 97/00* (2006.01)

(52) U.S. Cl.
CPC ..... *A47B 97/00* (2013.01); *A47B 2097/008* (2013.01)

(58) Field of Classification Search
CPC .... A47B 97/00; A47B 2097/008; A47B 67/04
USPC ..... 312/330.1, 204, 279, 278, 224, 351.1, 312/352; D6/670, 663, 668, 668.2, 671.1
See application file for complete search history.

(56) References Cited

U.S. PATENT DOCUMENTS

| | | | | | |
|---|---|---|---|---|---|
| 129,704 | A | * | 7/1872 | Andrews | A47B 21/00 248/316.3 |
| 451,436 | A | * | 4/1891 | Rannion | |
| D22,730 | S | * | 8/1893 | Shoudy | |
| D23,330 | S | * | 4/1894 | Shoudy | |
| 658,999 | A | * | 10/1900 | Scannell | |
| 821,167 | A | * | 5/1906 | Hurt et al. | |
| D46,792 | S | * | 12/1914 | Purcell | |
| 1,233,775 | A | * | 7/1917 | Hagar | A47F 3/00 312/278 |

(Continued)

FOREIGN PATENT DOCUMENTS

| | | | |
|---|---|---|---|
| FR | 2620303 | * | 3/1989 |
| FR | 2979210 | * | 3/2013 |
| WO | WO002493 | * | 5/2000 |

OTHER PUBLICATIONS

DE20116637 Zerver; abstract and figure (Year: 2001).*

(Continued)

*Primary Examiner* — Janet M Wilkens
(74) *Attorney, Agent, or Firm* — Brian Roffe

(57) ABSTRACT

Furniture anti-tipping mechanism integrated into furniture includes a bracket attachable to a vertical support, a substantially planar wall section situated in the furniture and having front and rear surface defining a thickness therebetween constituting a rear wall of the furniture, and attachment structure to connect the bracket to the wall section. The attachment structure may include at least one bolt projecting from the bracket and having a height greater than the thickness of the wall section, at least one aperture in the wall section, and at least one wing nut threadable onto a respective bolt after the bolt projects through a respective aperture to enable the wall section to be tightened against the bracket.

20 Claims, 46 Drawing Sheets

(56) References Cited

U.S. PATENT DOCUMENTS

| | | | | | |
|---|---|---|---|---|---|
| 1,376,203 | A * | 4/1921 | Himes | A47F 3/00 | 312/114 |
| 1,730,391 | A * | 10/1929 | Stobba | A47B 77/10 | 312/317.3 |
| 2,104,214 | A * | 1/1938 | Vezina | A47F 3/00 | 312/234 |
| D182,833 | S * | 5/1958 | Lubbert et al. | D6/671.1 | |
| 4,120,549 | A * | 10/1978 | Bureau | A47B 67/04 | 280/47.35 |
| 4,214,323 | A | 7/1980 | Thomas | | |
| D305,485 | S * | 1/1990 | Zalesak | D6/662.1 | |
| 5,013,103 | A * | 5/1991 | Addison | A47B 21/00 | 248/316.3 |
| 5,352,031 | A * | 10/1994 | Nahrgang | A47B 88/467 | 182/129 |
| 6,068,355 | A * | 5/2000 | Thorp | A45C 9/00 | 108/177 |
| D467,096 | S * | 12/2002 | DiCostanzo | D6/670 | |
| 6,508,525 | B2 * | 1/2003 | Picogna | A47B 37/02 | 312/196 |
| 6,533,238 | B2 | 3/2003 | Barnes et al. | | |
| 9,955,786 | B2 | 5/2018 | Kato | | |
| 10,113,687 | B2 | 10/2018 | Wise | | |
| 2003/0221593 | A1 | 12/2003 | Usagani | | |
| 2006/0207989 | A1 | 9/2006 | Ritchie et al. | | |
| 2007/0039640 | A1 | 2/2007 | Zheng | | |
| 2011/0043088 | A1 * | 2/2011 | McConnell | A47B 43/00 | 312/334.7 |
| 2017/0021958 | A1 | 1/2017 | Shelton | | |

OTHER PUBLICATIONS

CN209474157 Chang et al; abstract and figure (Year: 2019).*
English translation FR2620303 (Year: 1989).*
No, Dressers Don't Need to Be Anchored to a Wall, by John Brownlee, Jul. 13, 206, downloaded Jan. 26, 2020.

* cited by examiner

ANTI-TIPPING MECHANISMS INTEGRATED INTO FURNITURE

FIELD OF THE INVENTION

The present invention relates generally to anti-tipping mechanisms for furniture that prevent the furniture from tipping over when, for example, a child is climbing on a drawer of the furniture or reaching the top to have it tip forward. The anti-tipping mechanisms may be completely separate from the furniture or involve specific construction of the furniture.

BACKGROUND OF THE INVENTION

Furniture tipping accidents and deaths are on the rise. The majority many of toddler furniture pieces, typically dressers, are anywhere from about 16 inches to about 24 inches deep and often toddlers can grab the top of the dresser, grab the top drawer of the dresser and even climb into the bottom drawer of the dresser before the parent is aware of this. Top drawers of these dressers often have heavy contents in them further making the dresser more easy to tip over, which when it occurs, often results in the toddler getting severely hurt, sometimes even rushed to the hospital and even more worrisome, a tragic death.

Many products on the market currently offer the ability to attach the upper back of a piece of furniture, e.g., a dresser, to the wall or other vertical support behind the dresser with a webbing strap or cable so the tipping issue is caught and restricted before the entire dresser falls forward. Yet, this can also allow the topmost dresser drawer to fall forward and still cause accidents. Proper fastening of the dresser to the wall poses yet another issue insofar as it is possible that the screws on the wall or the screws on the dresser are ripped apart when the tipping force is too much, especially if the webbing strap or cable is not attached properly in a safe or secure manner and location. After all, most dresser backs are very cheaply made with the backs often ⅛" thin pressboard or plywood and the frame is typically ⅝"-¾" and made of plywood or even less secure presswood typically used today.

Also, it is possible that the wall mounting was installed without the use of appropriate hardware such as mollies or lead plugs. If that were so, it would take little force for the tipping force exerted by the child or toddler to "rip" a wall-mounting bracket right off the wall thus allowing the dresser to continue its fall. Furthermore, if the frame is presswood, it would not take much force to "rip off" the mounting screws securing the webbing or cable to the frame or back.

OBJECTS AND SUMMARY OF THE INVENTION

It is an object of at least one embodiment of the present invention to provide new and improved mechanisms for integrating or incorporating into pieces of furniture to prevent the furniture from tipping over.

It is another object of at least one embodiment of the present invention to provide a new and improved design configuration to reduce the likelihood of furniture from tipping over.

It is another object of at least one embodiment of the present invention to provide a mechanism to significantly resist a baby or toddler from forcefully engaging an upper region of a dresser while approaching the dresser with an adequate stance to effect the possibility of causing danger to the baby or toddler.

It is yet another object of at least one embodiment of the present invention to provide a dresser that resists tipping when a top drawer of the dresser is open.

It is still another object of at least one embodiment of the present invention to provide a dresser that resists tipping when the toddler physically engages an open bottom drawer of the dresser or reaching the upper region of the dresser and pulling (tipping) it forward.

Another object of at least one embodiment of the present invention is to provide a dresser that resists tipping even when the toddler climbs on or into a bottom drawer region of the dresser.

A furniture anti-tipping mechanism integrated into furniture in accordance with the invention includes a bracket attachable to a vertical support, a substantially planar wall section situated in the furniture and having front and rear surface defining a thickness therebetween constituting a rear wall of the furniture, and attachment means to connect the bracket to the wall section. The attachment means may include at least one bolt projecting from the bracket and having a height greater than the thickness of the wall section, at least one aperture in the wall section, and at least one wing nut threadable onto a respective bolt after the bolt projects through a respective aperture to enable the wall section to be tightened against the bracket.

In one embodiment, the bracket includes a central planar portion and side flanges in a common plane with one another but in a different plane than the planar portion. Each bolt projects from the central portion to a side away from the side flanges.

In some embodiments, the furniture includes an access door in an upper panel to enable access to a space under the upper panel to access any wing nuts. The furniture may include a utility tray insertable into the space and accessible via the access door.

In other embodiments, the attachment means include at least one projection projecting from the bracket and each including a slot, at least one aperture in the wall section configured to accommodate a respective projection, and a lashing strap including a strap, passable through the slot in each projection and inside of the wall section when each projection is accommodated in the respective aperture, to enable the wall section to be tightened against the bracket. There may be two projections spaced apart from one another, in which case, there are two apertures spaced apart from one another. The lashing strap optionally includes a locking buckle engaging with the strap to tighten and release the strap. A optional hold down bracket is situated on an inside of the wall section to retain an excess length of the strap. If the access door is present, it enables access to the lashing strap.

Another embodiment of a piece of furniture in accordance with the invention includes a frame, a bottommost drawer movable into and at least partly out of the frame, and a post on the bottom drawer. The post extends downward from a front panel of the bottom drawer a distance approximately equal to a height of legs of the furniture to enable the post to provide an additional support for the furniture. The post may be fixed to the bottom drawer. If the frame includes a molding below the bottom drawer, the molding is provided with a cut-out configured to allow entry of the post into the cut-out when the drawer is in a position in the frame. An additional post may be provided on the bottom drawer, and which extends downward from a front panel of the bottom drawer a distance approximately equal to a height of legs of the furniture to enable the additional post to provide another support for the furniture.

Another embodiment of a piece of furniture in accordance with the invention includes a frame, and at least one drawer movable into and at least partly out of the frame. The frame includes an upper section and a lower section a having a greater front to back distance than the upper section. The frame may include two rear vertical supports that are elongate and straight and two front vertical supports each aligning with a respective rear vertical support. Each front vertical support includes a first elongate and straight section in the upper section and a second elongate and straight section in the lower section which is at an angle to the first section.

In one embodiment, the frame includes two rear vertical supports that are elongate and straight and two front vertical supports that are elongate and straight and each aligning with a respective rear vertical support. The front vertical supports are angled along their entire length forward.

In another embodiment, the frame includes two rear vertical supports that are elongate and straight and two front vertical supports that are elongate and straight and each aligning with a respective rear vertical support. The front vertical supports are angled along their entire length forward and the rear vertical supports are angled along their entire length rearward.

In yet another embodiment, the frame includes two rear vertical supports that are elongate and straight and two front vertical supports each aligning with a respective rear vertical support. Each front vertical support includes a forwardly curved portion in the upper section.

The frame may include side panels that each extend over the entirety of a respective right and left sides of the frame and define front and rear legs. Alternatively, the side panels may each extend over the entirety of a respective right and left sides of the frame but not over front and rear legs of the furniture.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

One of the inventors' ideas to address the tipping problem of furniture in the presence of toddlers and children is that it is advantageous, instead of addressing attachment of a dresser or other piece of furniture to the wall against which it is placed, to address stability and retention of support legs of the furniture by attaching extensions or boots at least partly under and to the support legs to provide superior anti-tipping characteristics (for toddlers, parents, even TV stands). The extensions (having a form similar in appearance to a boot) provide a 16-18 inch deep dresser the ability to function as if it were 24-28 inches (depending on the length of the extensions). Various boots or extensions are disclosed below.

In the embodiments disclosed herein, a dresser is often used as an example of a piece of furniture for which the anti-tipping mechanism may be used, and in which an anti-tipping mechanism may be integrated or incorporated. The anti-tipping mechanisms of the invention can be used on other types of furniture in addition to dressers and are not limited to use with only dressers.

Figure 1:
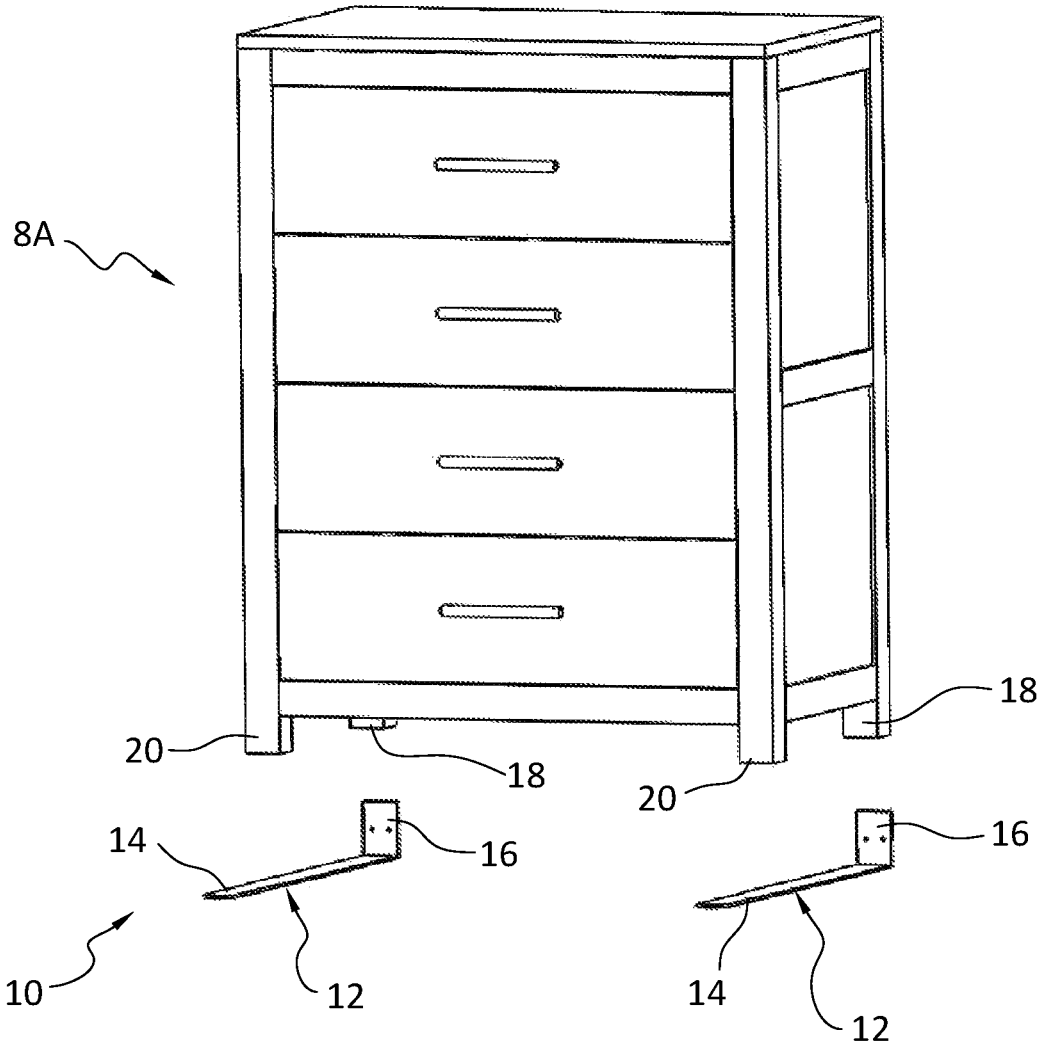
FIG. 1 is a perspective view of a dresser including a first embodiment of an anti-tipping mechanism in accordance with the invention shown detached from the dresser.
Figure 2:
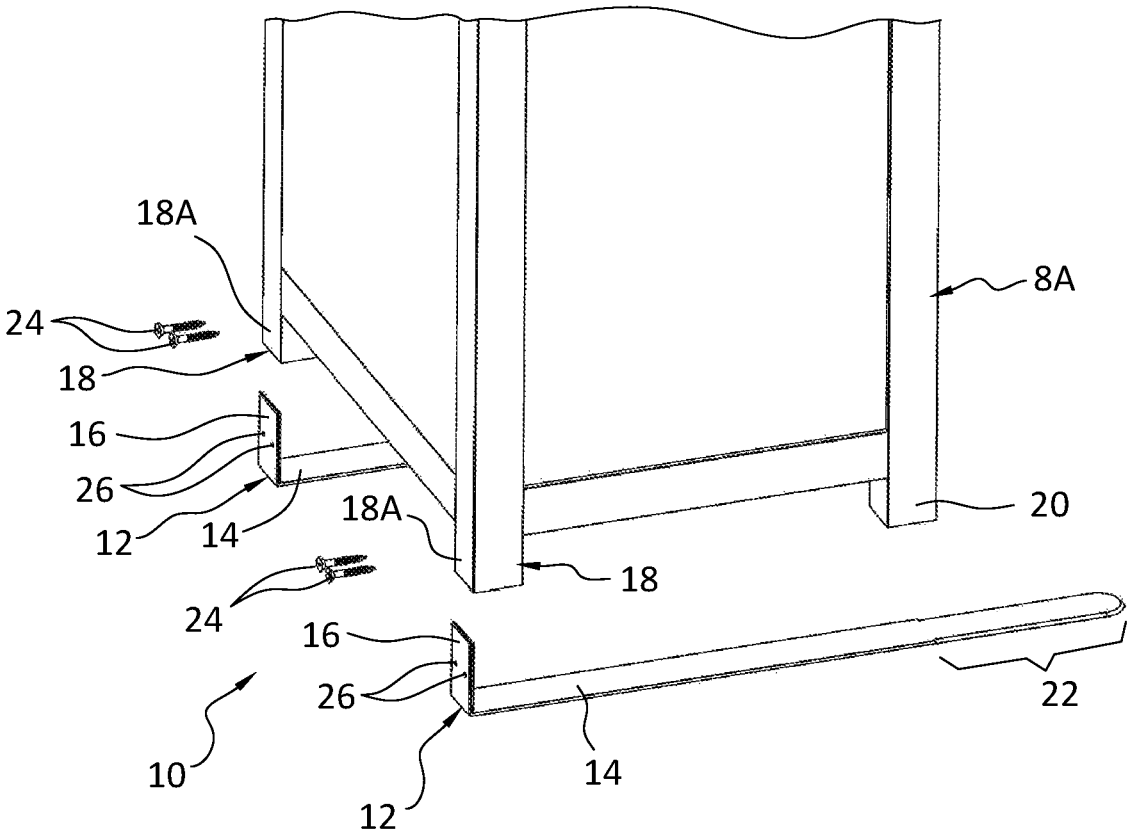
FIG. 2 is a rear perspective view of the dresser shown in FIG. 1 with the anti-tipping mechanism shown detached from the dresser.
Figure 3:
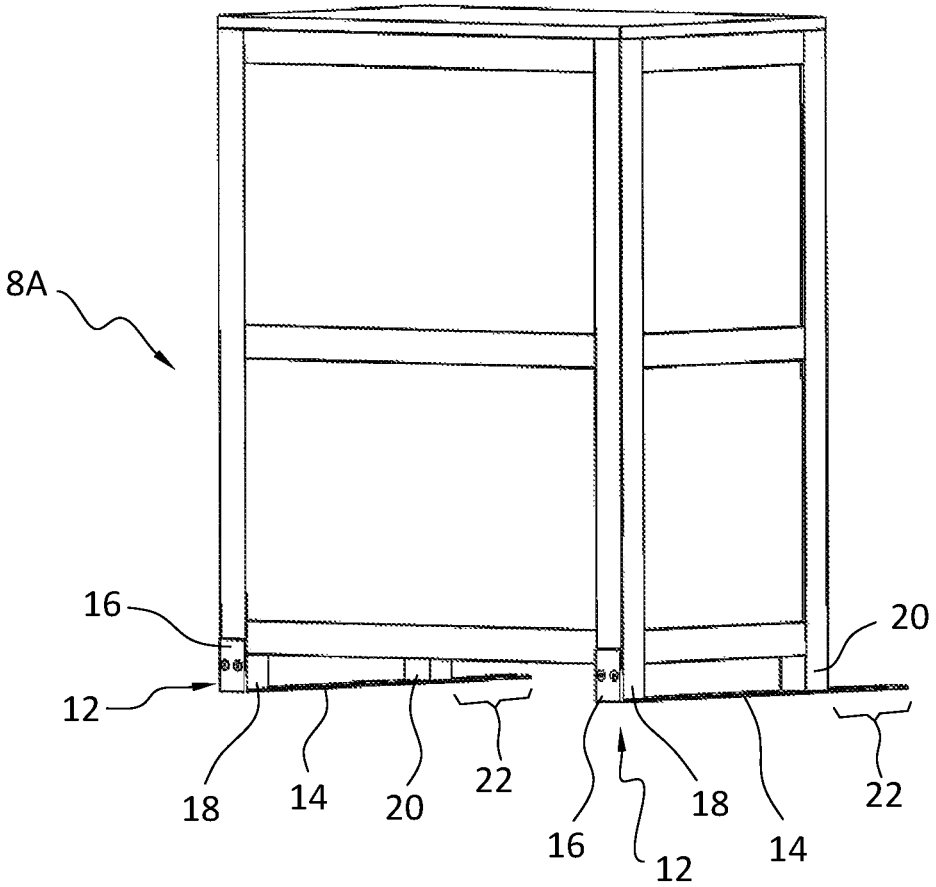
FIG. 3 is a rear view of the dresser shown in FIG. 1 with the anti-tipping mechanism attached to the dresser.

FIGS. 1-3 show a dresser 8A including a first embodiment of an anti-tipping mechanism in accordance with the invention designated generally as 10. Anti-tipping mechanism 10 includes a fixed angled L-shaped extension or boot 12 that has a first planar portion 14 and a second planar portion 16 at a fixed angle relative to the first planar portion 14. The planar portions 14, 16 may be rigid and permanently attached to one another so that the angle between them is not variable. The planar portions 14, 16 may be solid or hollow or have any construction that enables them to support the dresser 8A without being damaged. Also, the planar portions 14, 16 may be made of a sturdy, supportive material such as a type of metal such as stainless steel or electroplated carbon, etc. with 14 or 16 gauge as examples, or unbreakable plastic such as polycarbonate (for clear parts) or rigid nylon or Delrin (Acetal) for solid colors. Ideally, the plastic parts would have typical wall thicknesses ranging from about ⅛ inches to about 3/16 inches.

The first planar portion 14 is elongate and dimensioned relative to the dresser 8A (FIG. 1) it is to be used with so that when the second planar portion 16 attached to a rear surface 18A of a rear leg 18 of the dresser 8A, the first planar portion 14 extends a distance beyond the front leg 20 (this distance being represented as 22, see FIGS. 2 and 3). As such, it is envisioned to make a plurality of different L-shaped boots 12 to fit different sizes of dressers 8A.

The angle between the first and second planar portions 14, 16 is dependent on the angle between the rear surface 18A of the rear leg 18 and the often horizontal surface on which the dresser 8A is to be placed. As shown, the fixed angle is about 90°, i.e., the second planar portion 16 is perpendicular to the first planar portion 14 which is to rest on the horizontal surface. The reason for this in the illustrated embodiment is because the bottom surface of the rear leg 18 is designed to lie flat against the horizontal surface when the dresser 8A is placed on the horizontal surface (of the L-shaped boot 12 were not present) and the rear surface 18A of the rear leg 18 is perpendicular to the bottom surface of the rear leg 18.

The angle however is determined by the shape of the rear leg 18 and specifically, the angle between the bottom surface of the rear leg 18 and the rear surface 18A of the rear leg 18 since it is desired that the surface of the second planar portion 16 be alongside and in contact with the rear surface 18A of the rear peg 18 after installation and during use. Another embodiment described below (FIGS. 4-6) provides for variability of the anti-tipping mechanism to addressed different angles.

The second planar portion 16 is attached to the rear surface 18A of the rear leg 18 to be in contact therewith by any suitable attachment means which provide a secure attachment of the L-shaped boot 12 to the rear leg 18. The anti-tipping mechanism 10 therefore comprises the boot 12 and the attachment means to attach the boot 12 to a piece of furniture.

As shown in FIG. 2, the attachment means comprise screws 24 which fit through apertures 26 in the second planar portion 16. One skilled in the art would appreciate that different attachment means may be used providing either a temporary or permanent attachment, e.g., nails or bolts. The attachment means should be selected to avoid separation of the rear leg 18 from the second planar portion 16 when a tipping force is exerted as this would frustrate the purpose of the L-shaped boots 12. Attachment means therefore may be construed as structure that provides for a secure attachment of one component to another component when a force is exerted on the other component. If bolts are used, a threaded insert may be pre-drilled and inserted in the rear of the rear leg 18. A screw, on the other hand, may be screwed into a starting hole formed in the rear leg 18.

In an exemplifying, non-limiting use, the L-shaped boot 12 may be attached to each rear leg 18 of the dresser 8A (see FIG. 3). The specific size L-shaped boot 12 is selected so that the first planar portion 14 thereof extends forward of the front leg 20. The longer the extension 22 of the first planar portion 14 forward of the front leg 20, the greater the resistance of the dresser 8A to tipping. In an attempt to tip the dresser 8A, there would be a downward force exerted against the extended portion 22 of the first planar portion 14 forward of the front leg 20 and this would hinder tipping of the dresser 8A.

One skilled in the art would be able to determine the distance of the extended portion 22 of the first planar portion 14 forward of the front leg 20 relative to characteristics of the dresser 8A, e.g., the height of the dresser 8A, the depth of the dresser 8A, the weight of the dresser 8A, and the number of drawers in the dresser 8A. As an example, if the dresser 8A has seven drawers, and is five feet high and nineteen inches deep (such dimensions being typical of a tippable dresser), then the L-shaped boots 12 should extend a number of inches forward of the dresser 8A to provide tip resistance. The more forward the L-shaped boots 12 extend, the more resistance to tip is provided to the dresser 8A.

The extended portion 22 has edges that may be contoured, e.g., curved and tapered to present a smooth surface as someone might walk over the extended portion 22. The front edge of the extended portion 22, i.e., the front edge of the first planar portion 14 of the L-shaped boot 12 may be in the shape of a semi-circular. It is envisioned that in some uses, the extended portion 22 is positioned underneath carpet or other floor covering to hide the extended portion 22. Placing them under a firm carpet may further assist in resisting tipping.

Boots 12, and other boots or extensions disclosed herein can be produced in plastic, as well as metal. In plastic, there can be the nice tapered edges on the front of the parts, however, if produced from metal, it may be desirable to use a typical stock of 16 gauge (0.060") or 14 gauge (0.0781") stainless steel or electroplated carbon steel. The boots 12 may be constructed with or without any edges being tapered, and with a rounded or square front, etc.

Figure 4:
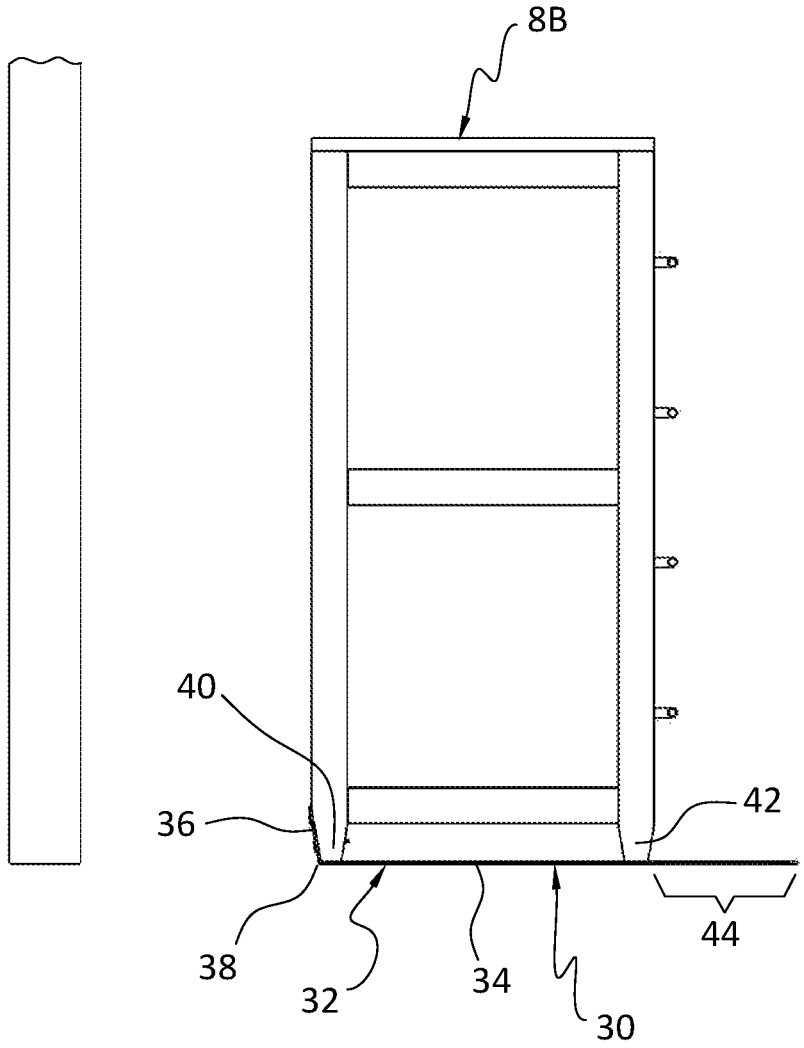
FIG. 4 is a side view of a dresser including a second embodiment of an anti-tipping mechanism in accordance with the invention shown attached to the dresser.
Figure 5:
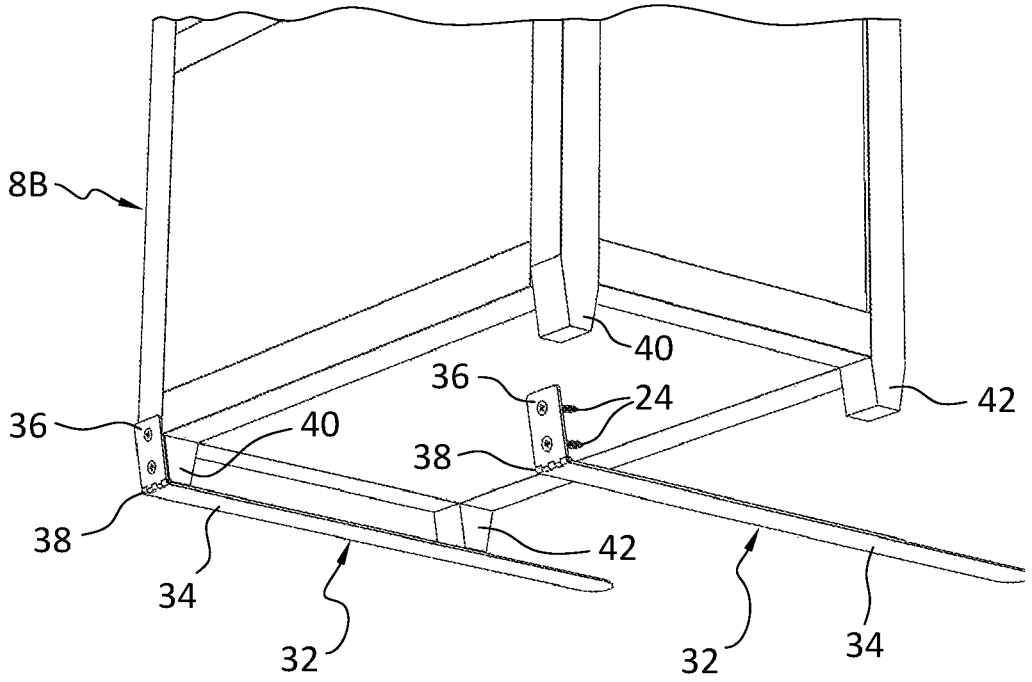
FIG. 5 is a rear perspective view of the dresser shown in FIG. 4 with the anti-tipping mechanism shown attached to the dresser.
Figure 6:
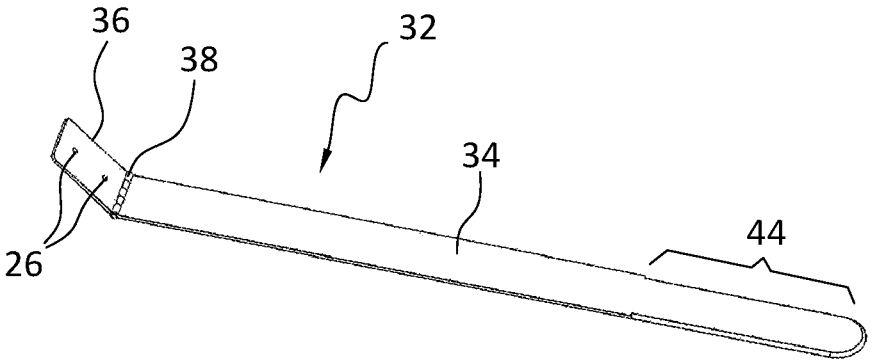
FIG. 6 is a perspective view of a part of the second embodiment of the anti-tipping mechanism.

FIGS. 4-6 show another anti-tipping mechanism in accordance with the invention which is designated 30 and includes an extension or boot 32 having first and second planar portions 34, 36 that are not rigidly fixed to one another (as in boot 12 in FIGS. 1-3), but rather are pivotally connected to one another by a hinge mechanism 38. Hinge mechanism 38 allows the second planar portion 36 to move to different angles and different angular positions relative to the first planar portion 34.

A primary advantage of the use of hinge mechanism 38 rotatably connecting the first and second planar portions 34, 36 is to account for different angles between the bottom surface of the rear leg 40 and the rear surface of the rear leg 40 of the dresser 8B. In the embodiment of FIGS. 1-3, this angle was about 90 degrees, but sometimes in actuality, the angle is different than 90 degrees, usually greater than 90 degrees. For example, as shown in FIGS. 4 and 5, the angle is about 110 degrees. Therefore, use of the fixed angle L-shaped boot 12 is not possible for the dresser 8B shown in FIGS. 4 and 5. Rather, variable angle, hinged boot 32 must be used. Hinged boot 32 has the advantage over the boot 12 insofar as it will accommodate most angles of the rear legs 40. It is estimated that fixed 90 degree boots, i.e., boot 12, will fit about 75% to about 90% of all existing dressers.

The first planar portion 34 is elongate and dimensioned relative to the dresser 8B, or other piece of furniture it is to be used with, so that when attached to the rear surface of the rear leg 40, the first planar portion 34 extends a distance beyond the front leg 42, this distance being represented as 44, see FIGS. 4 and 5. As such, it is envisioned to make a plurality of different boots 32 to fit different sizes of dressers 8B.

The planar portions 34, 36 may be solid or hollow or have any construction that enables them to support the dresser 8B without being damaged. Also, the planar portions 34, 36 may be made of a sturdy, supportive substantially unbreakable material.

In use, the angle to which the second planar portion 36 is pivoted relative to the first planar portion 34 is dependent on the angle between the rear surface of the rear leg 40 and the horizontal surface on which the dresser 8B is to be placed. The angle is thus determined by the shape of the rear leg 40 and specifically, the angle between the bottom surface of the rear leg 40 and the rear surface of the rear leg 40.

Hinge mechanism 38 may be any conventional hinge or pivot-providing structure that enables movement of one member relative to another to different angular positions. In a basic construction, hinge mechanism 38 includes a first part attached to the first planar portion 34 and a second part attached to the second planar portion 38 and one or more pivot pins between these parts, and possibly attached to only one of the parts.

The second planar portion 36 could, in a storage or shipping state, be pivoted against the first planar portion 34, i.e., the forward-facing surface of the second planar portion 36 is against the upper surface of the first planar portion 34, and then for installation, raised from this position to the necessary angle. The installer would position the second planar portion 36 against the rear surface of the rear leg 40 and then attach the screws 24 through apertures (which apertures 26 can be seen in FIG. 6), or using other attachment means. The anti-tipping mechanism 30 therefore comprises the boot 32 and the attachment means to attach the boot 32 to a piece of furniture.

In an exemplifying, non-limiting use, a boot 32 may be attached to each rear leg 40 of the dresser 8B (see FIG. 5). The specific size boot 32 is selected so that the first planar portion 34 thereof extends forward of the front leg 42. The longer the extension 44 of the first planar portion 34 forward of the front leg 42, the greater the resistance of the dresser 8B to tipping. In an attempt to tip the dresser 8B, there would be a downward force exerted against the extended portion 44 of the first planar portion 34 forward of the front leg 42 and this would hinder tipping of the dresser 8B.

One skilled in the art would be able to determine the distance of the extended portion 44 of the first planar portion 34 forward of the front leg 42 relative to characteristics of the furniture, e.g., the height of the dresser 8B, the depth of the dresser 8B, the weight of the dresser 8B, and the number of drawers in the dresser 8B. As an example, if the dresser 8B has seven drawers, and is five feet high and nineteen inches deep (such dimensions being typical of a tippable dresser), then the boots 32 should extend a number of inches forward of the dresser 8B to provide tip resistance.

Each planar section 34, 36 may have a wall thickness between about 0.100 inches and about 0.187 inches for flex resistance and rigidity. The boot 32 may be produced from sturdy unbreakable polycarbonate, e.g., for clear parts, Nylon, glass filled ABS and Acetal for opaque engineering thermo-plastics.

The extended portion 44 has edges that may be contoured, e.g., curved and tapered to present a smooth surface as someone might walk over the extended portion 44. The front edge of the extended portion 44, i.e., the front edge of the first planar portion 36 of the L-shaped boot 32 may be in the shape of a semi-circular and tapered down to an edge to resist possibly accidental tripping. It is envisioned that in some uses, the extended portion 44 is positioned underneath carpet or other floor covering to hide the extended portion 44. Ideally, this soothes things out and eliminates the chance of tripping.

FIGS. 7-11 show another embodiment of an anti-tipping mechanism designated 50 and which includes a different extension or boot 52 than either boot 12 or boot 32, but also includes attachment means. Differing from boot 32, boot 52 includes a first planar portion 54 that has a variable height, with the largest height at the end of extended portion or extension 56 and the smallest height at or proximate the edge adjacent the hinge mechanism 38 (see FIG. 9). The height may vary uniformly from the end of extension 56 to the hinge mechanism 38. Such a variable height planar portion 54 could nevertheless be provided on boot 12 if so desired.

Figure 10:
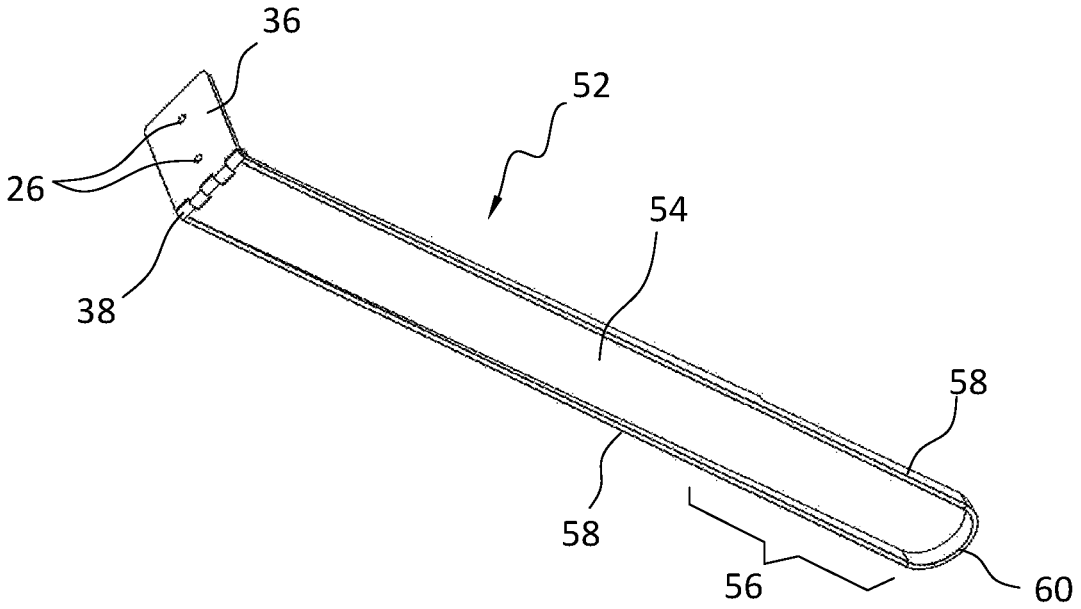
FIG. 10 is a bottom perspective view of a part of the third embodiment of the anti-tipping mechanism.

In the illustrated embodiment, the boot 52 has elongate, straight side ribs 58 and a front rib 60 connecting the front ends of the side ribs 58 to provide a horizontal support surface at a lower edge of the first planar portion 54 (see FIG. 10). The first planar portion 54 thus overlies a hollow cavity defined by the lower surface of the first planar portion 54 at the top, the inner surface of the side ribs 58 on the lateral sides, and the inner surface of the front rib 60 at the front, and possibly by the hinge mechanism 38 at the rear. Alternatively, the first planar portion 54 may be a solid.

Figure 7:
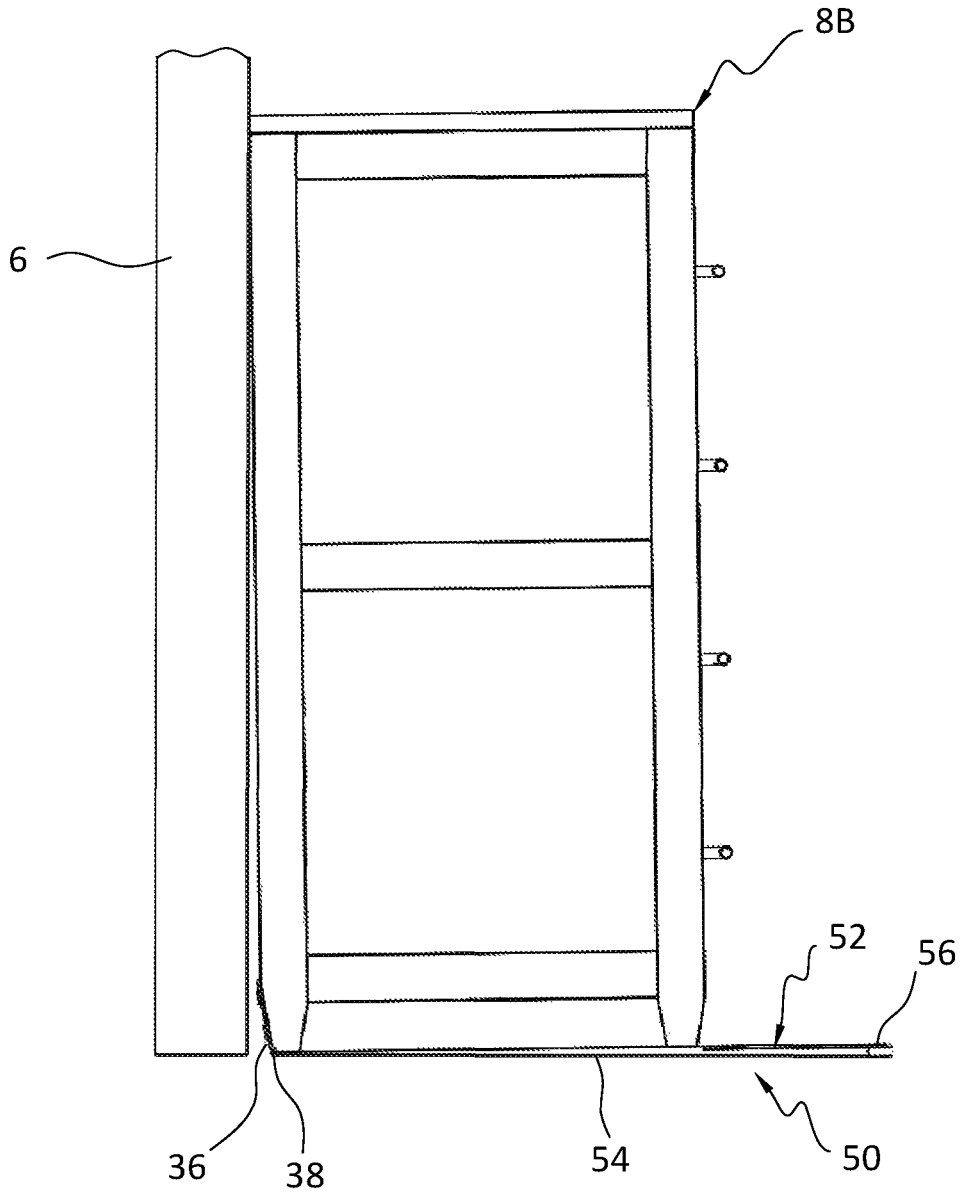
FIG. 7 is a side view of a dresser including a third embodiment of an anti-tipping mechanism in accordance with the invention shown attached to the dresser.
Figure 8:
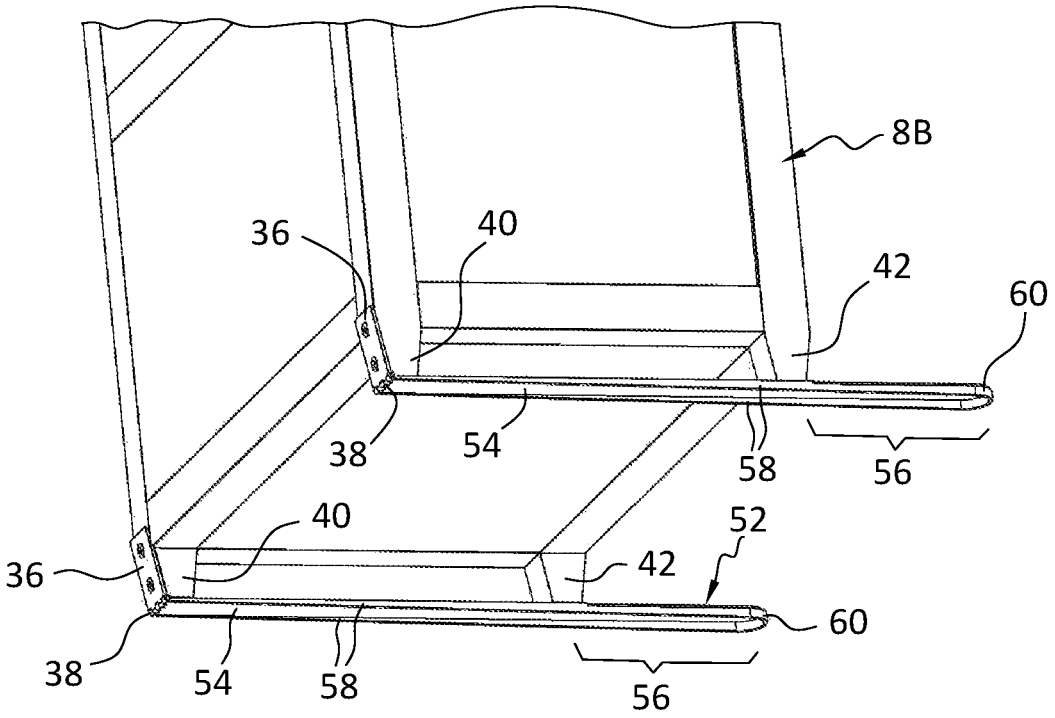
FIG. 8 is a rear perspective view of the dresser shown in FIG. 7 with the anti-tipping mechanism shown attached to the dresser.
Figure 9:
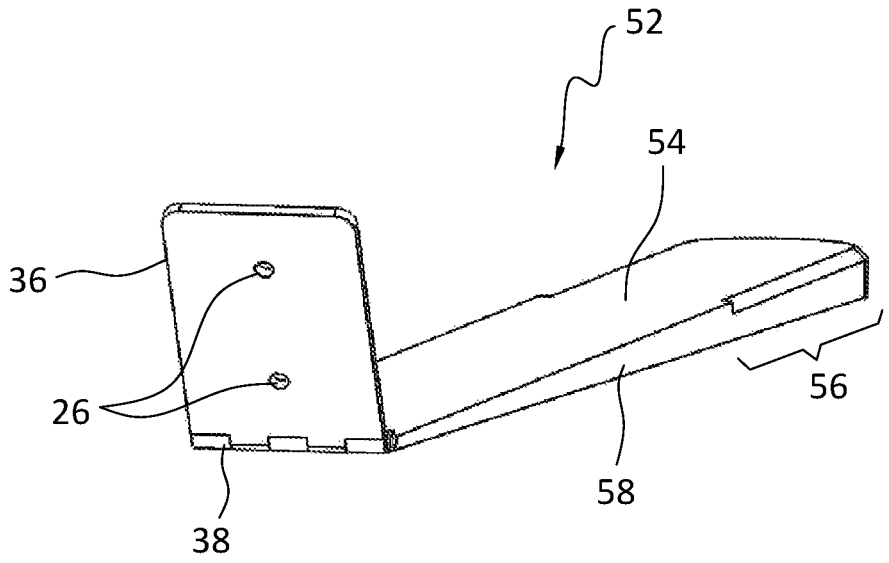
FIG. 9 is a top perspective view of a part of the third embodiment of the anti-tipping mechanism.
Figure 11:
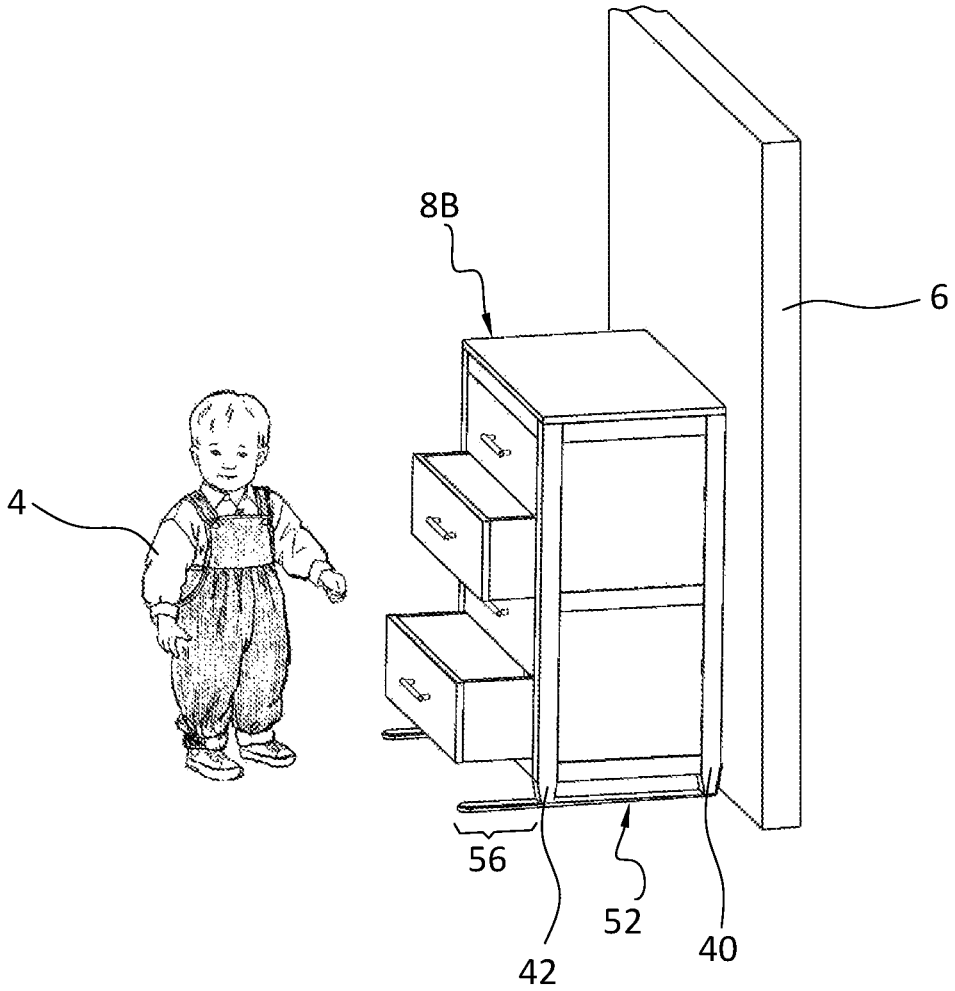
FIG. 11 is a side view of the dresser shown in FIG. 7 with a toddler in front potentially about to try to tip over the dresser.

This variable height results in the dresser 8B, when placed with its rear leg 40 and front leg 42 on the boot 52 as shown in FIGS. 7, 8 and 11, being slightly tilted rearward so that it is able to come into contact with a vertical wall 6 against which it is placed only at an upper portion (see in particular FIG. 7). Dresser 8B will not come into contact with the vertical wall 6 at the lower portion but rather will be spaced apart from the vertical wall 6 at the lower portion (see FIG. 7). The distance between the wall 6 and the rear of the dresser 8B increases in the direction from the top of the dresser 8B to the bottom of the dresser 8B. This rearward slanting of the dresser 8B resulting from the variable height boot 52 improves the tip resistance when a toddler or child 4 may try to pull the front of the dresser 8B (see FIG. 11).

The extension 56 has edges that may be contoured, e.g., curved to present a smooth surface as someone might walk over the extension 56. It is envisioned that in some uses, the extension 56 is positioned underneath carpet or other floor covering to hide the extension 56.

In the embodiments described above, the boots 12, 32, 52 are attached to the rear surface of the rear leg of the furniture. These uses are exemplifying only and do not limit the use of the boots 12, 32, 52. In some embodiments, it is envisioned that the boots 12, 32, 52 may be attached to another part of the furniture, e.g., the rear panel or rear wall of the furniture. In such cases, the legs 12, 32, 52 may extend forward of the front wall or front panel of the furniture at a location between the front legs, essentially sticking out in a middle region of and below the front wall or front panel. A single boot 12, 32, 52 may be used in these situations and would not be connected to the rear legs. The same attachment mechanism, e.g., screws, may be used to attach the boot 12, 32, 52 to the rear panel or rear wall of the furniture.

Figure 11A:
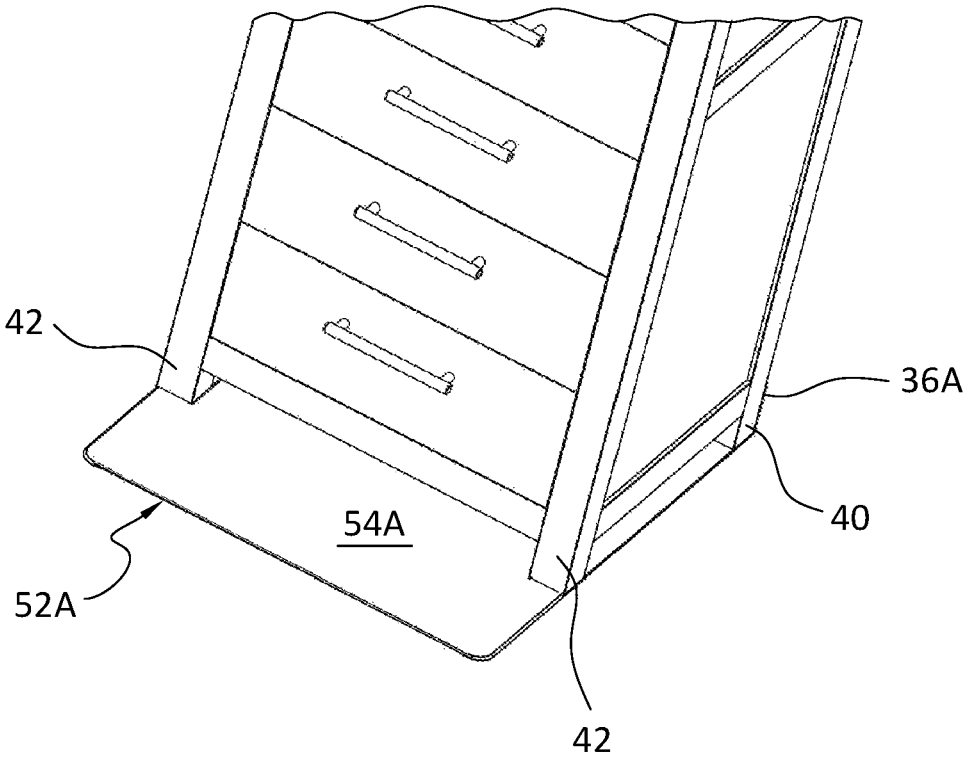
FIG. 11A is a perspective view of the dresser shown in FIG. 7 with a variant of the anti-tipping mechanism.

As shown in FIG. 11A, another embodiment wherein a single boot 52A is used is illustrated. This single boot 52A may have the form of boot 12, boot 32 or boot 52 and is preferably configured to have a width extending from the outer left side surfaces of the left set of legs 40, 42 to the outer right side surfaces of the right set of legs 40, 42. As such, the single boot 52A will extend below all of the legs 40, 42. The boot 52A may have a planar portion 54A which extends below all of the legs 40, 42, and which planar portion 54A may be angled as in boot 52.

Boot 52A also includes the planar portion(s) 36A at its rear that are used to attach the boot 52 to the furniture, e.g., the rear surfaces of the rear legs 40. There may be a single planar portion 36A that extends across the entire length of the boot 52, i.e., it would have the same width as the underlying planar portion 54A of the boot 52, or there may be two, spaced apart planar portions 36A that each only extend behind a respective one of the rear legs 40. These planar portions 36A may be rigid with the underlying planar portion 54A of the boot 52A as in boot 12, or pivotally attached thereto by hinges as in boot 32. In either situation, both rear legs 40 are attached to the same boot 52A.

The width of the boots 12, 32, 52 may also vary from that shown but be less than the full width of the furniture as in boot 52A shown in FIG. 11A. The width of the boots 12, 32, 52 may be 2 inches, 4 inches, 6 inches or 8 inches, for example, Other widths are also possible.

Figure 12:
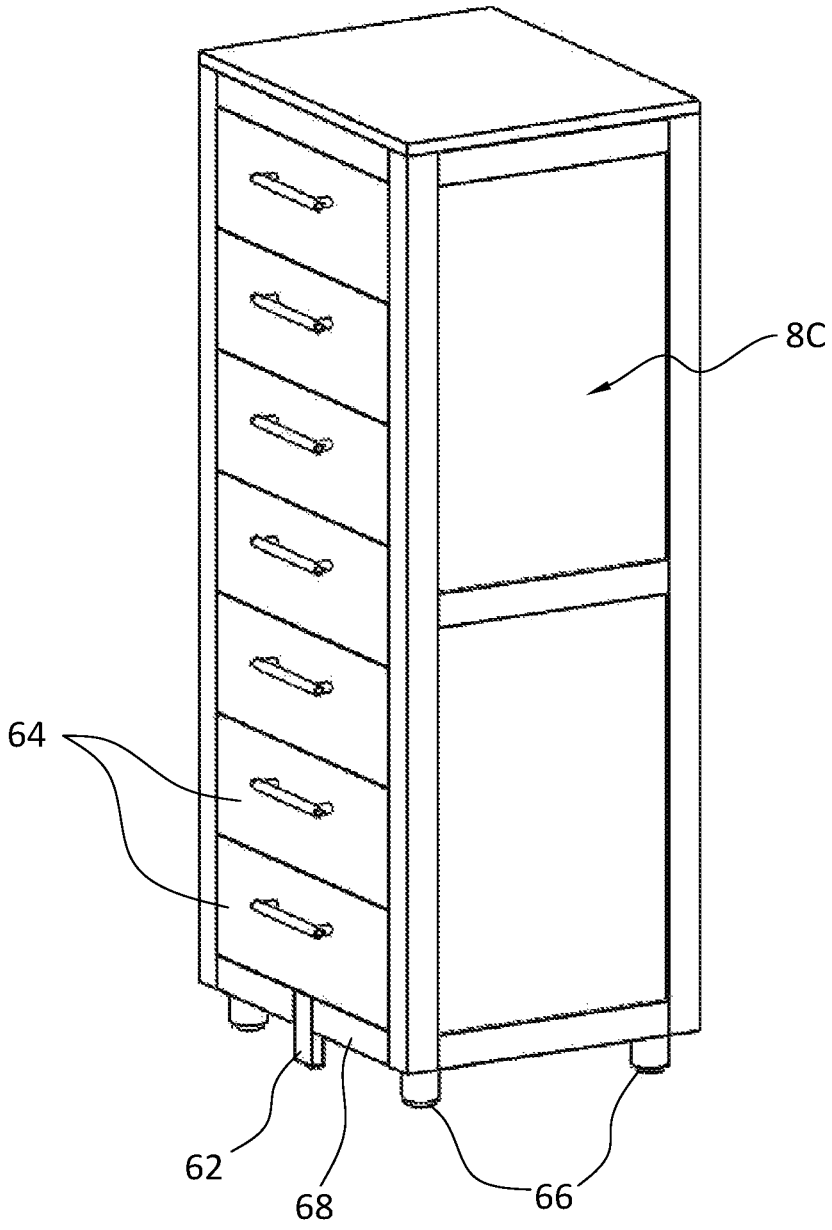
FIG. 12 is a front perspective view of a dresser including another embodiment of an anti-tipping mechanism in accordance with the invention.
Figure 13:
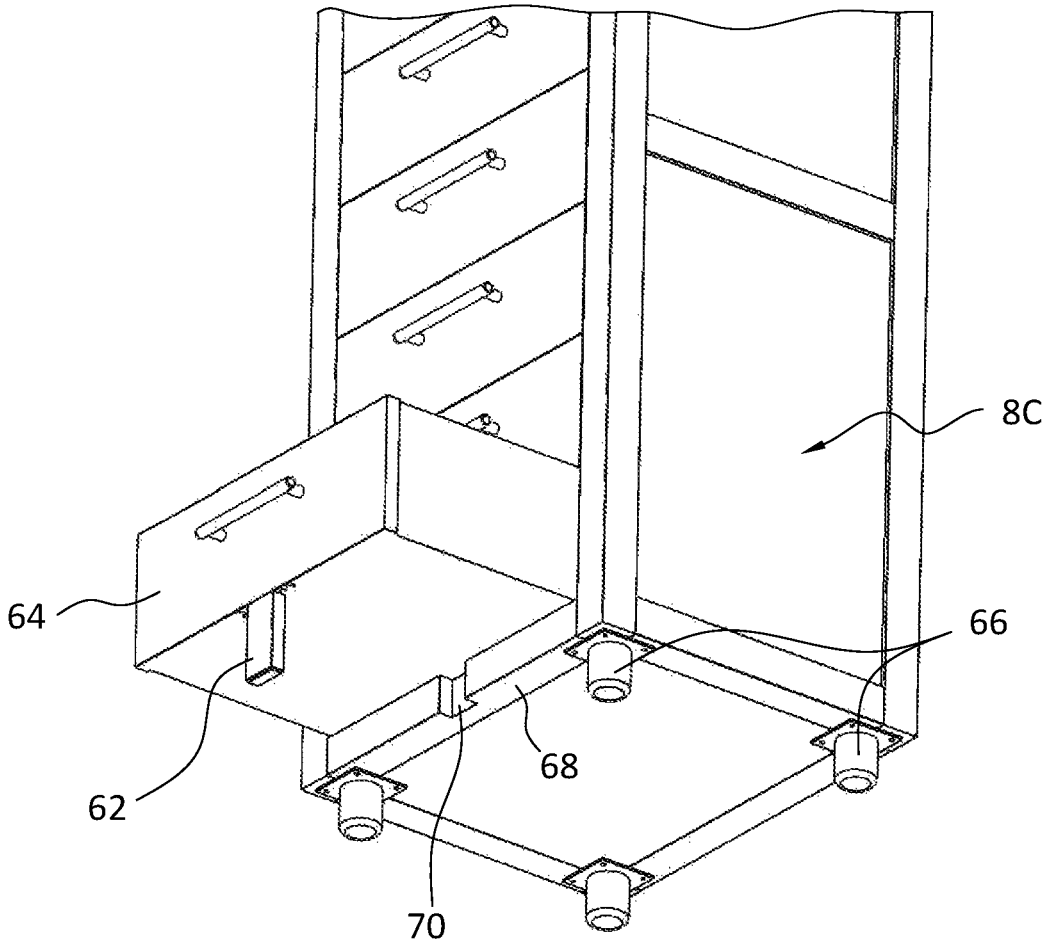
FIG. 13 is a bottom perspective view of the dresser shown in FIG. 12 with the bottom drawer in an open state.

FIGS. 12 and 13 show another embodiment of an anti-tipping mechanism in accordance with the invention which includes a fixed post 62 on the bottom drawer 64 of a dresser 8C. The fixed post 62 is rigid and is attached or integral with the bottom drawer 64 so as to provide a potential additional support point for the dresser 8C, along with support legs 66. Thus, the bottom surface of the fixed post 62 should be dimensioned to be close to the surface on which the dresser 8C is situated. Fixed post 62 serves to prevent forward tipping of the dresser 8C. The molding 68 on the dresser 8C ideally includes a cut-out 70 for the fixed post 62 (see FIG. 13).

As to this embodiment and other disclosed embodiments that have one or more fixed posts to the bottom drawer 64, this provides anti-tipping with the bottom drawer 64 when opened. Should a toddler climb into the bottom drawer 64, there would be resistance for the drawer 64 to fall forward. Each fixed post 62 is ideally at least about 0.25 inches shorter than the support legs 66 so when the bottom drawer 64 is opened, the fixed posts 62 do not interfere with drawer functionality. Since the distance to the floor is only about 0.25 inches, should a toddler climb into the drawer 64, the dresser 8C will only slightly fall forward.

Instead of a fixed post, a post could be pivotable between a position under the bottom drawer to an extended position.

Figure 14:
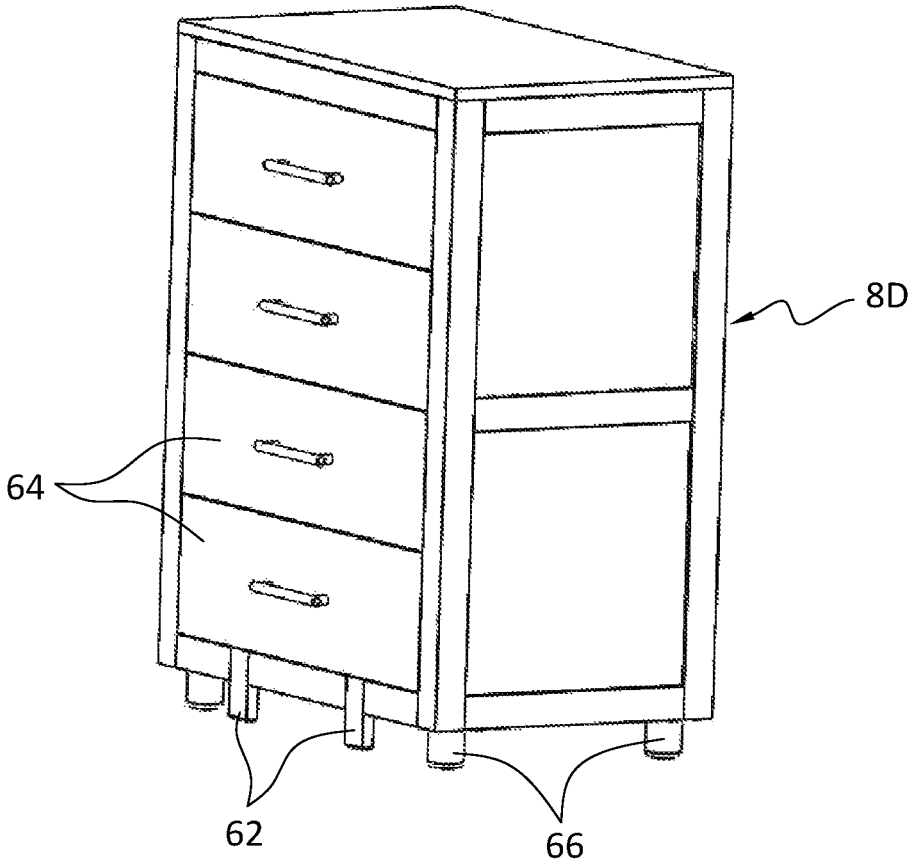
FIG. 14 is a front perspective view of a dresser including another embodiment of an anti-tipping mechanism in accordance with the invention.
Figure 15:
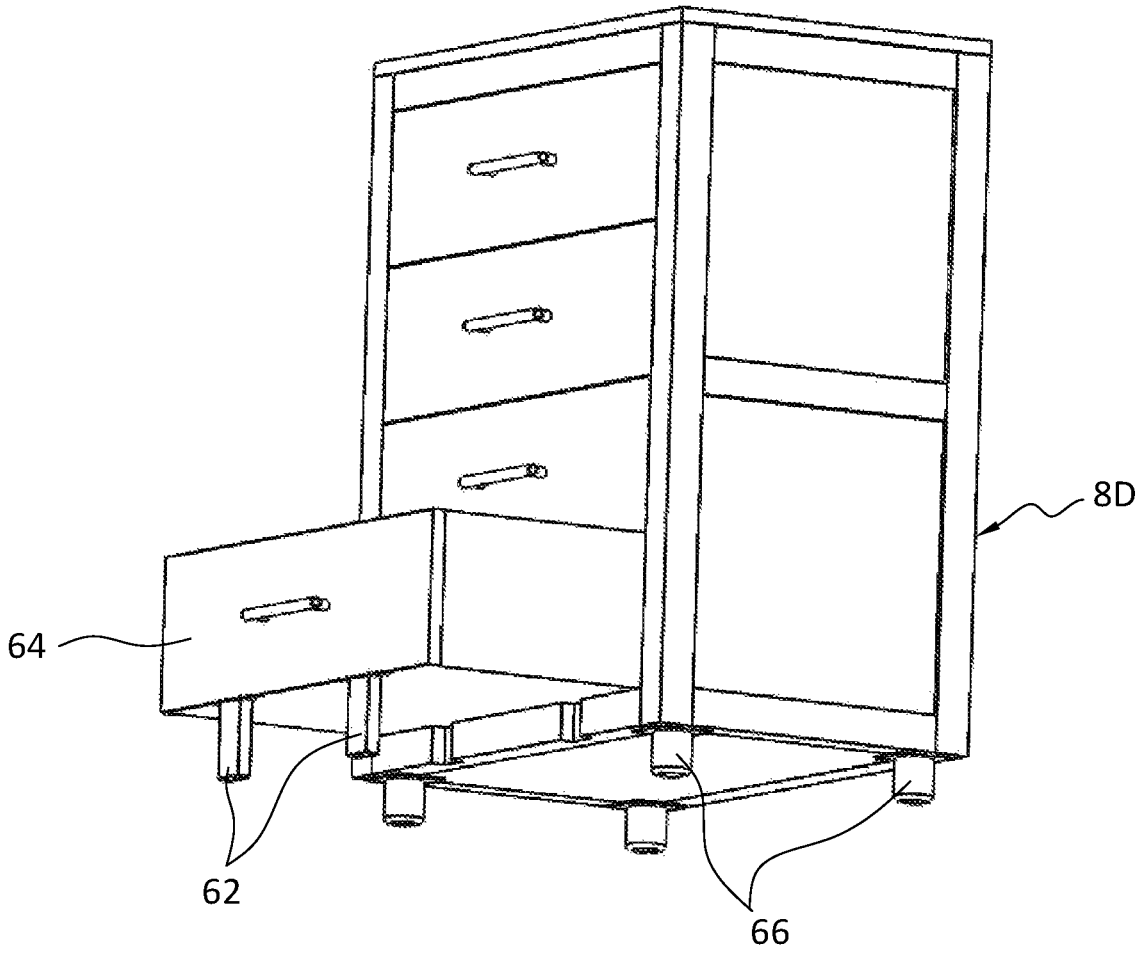
FIG. 15 is a front perspective view of the dresser shown in FIG. 14 with the bottom drawer in an open state.

While a single central fixed post as shown in FIGS. 12 and 13 will likely prevent an accident, an anti-tipping mechanism including two fixed posts 62 on the bottom drawer 64 of the dresser 8D will offer more positive floor surface engagement and resist cocking the dresser to pivot to one side, and is shown in the embodiment of in FIGS. 14 and 15. Ideally, the two posts 62 are placed a distance sufficiently apart from one another to provide stability as the drawer 64 tips about 0.25 inches forward and positively stops falling any further.

In many situations where the toddler is under 2 years old, it may very well be that he/she may not be able to reach any higher than the bottom drawer 64. If on the other hand, the toddler is 3, 4 or 5 years old, a superior choice may be to go with one of the boots disclosed herein. An embodiment of a dresser is also envisioned which includes both the boots as well as one or more fixed posts 62 for double anti-tipping insurance.

Figure 16:
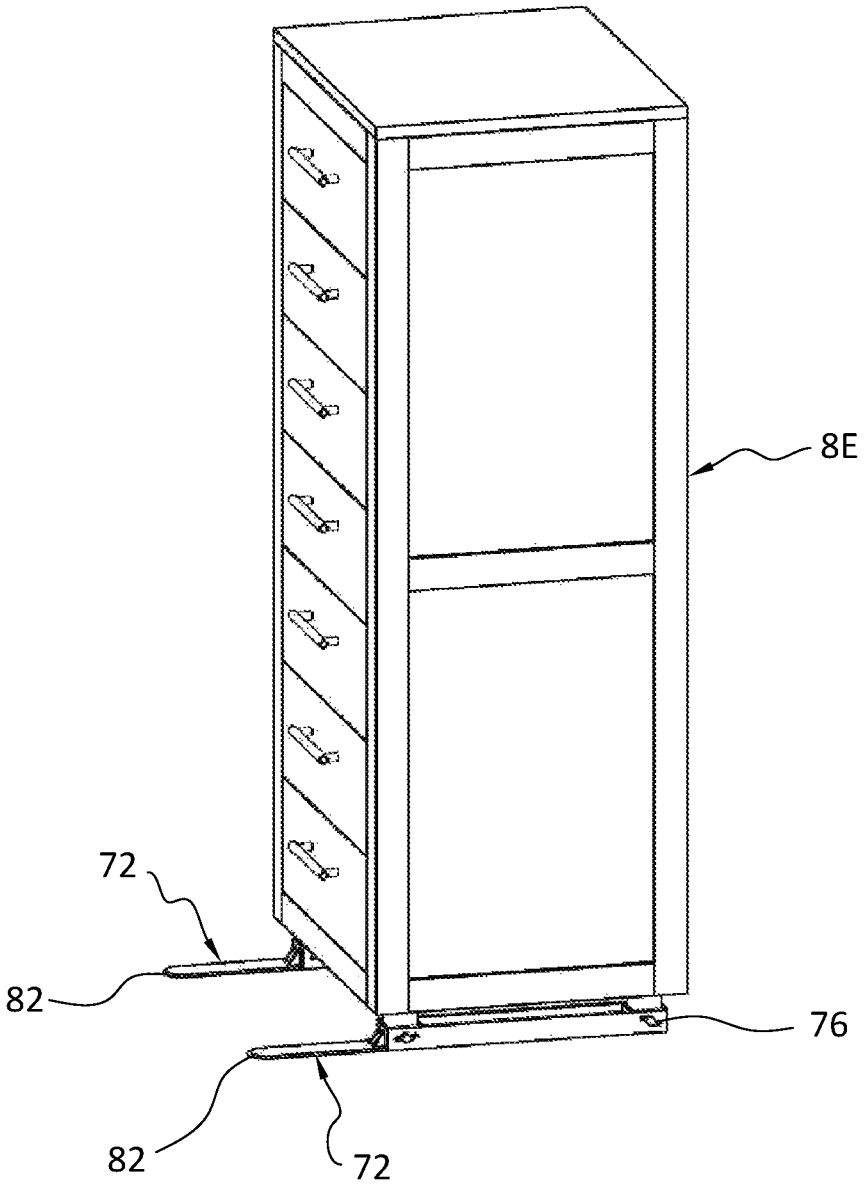
FIG. 16 is a side perspective view of a dresser including another embodiment of an anti-tipping mechanism in accordance with the invention.
Figure 17:
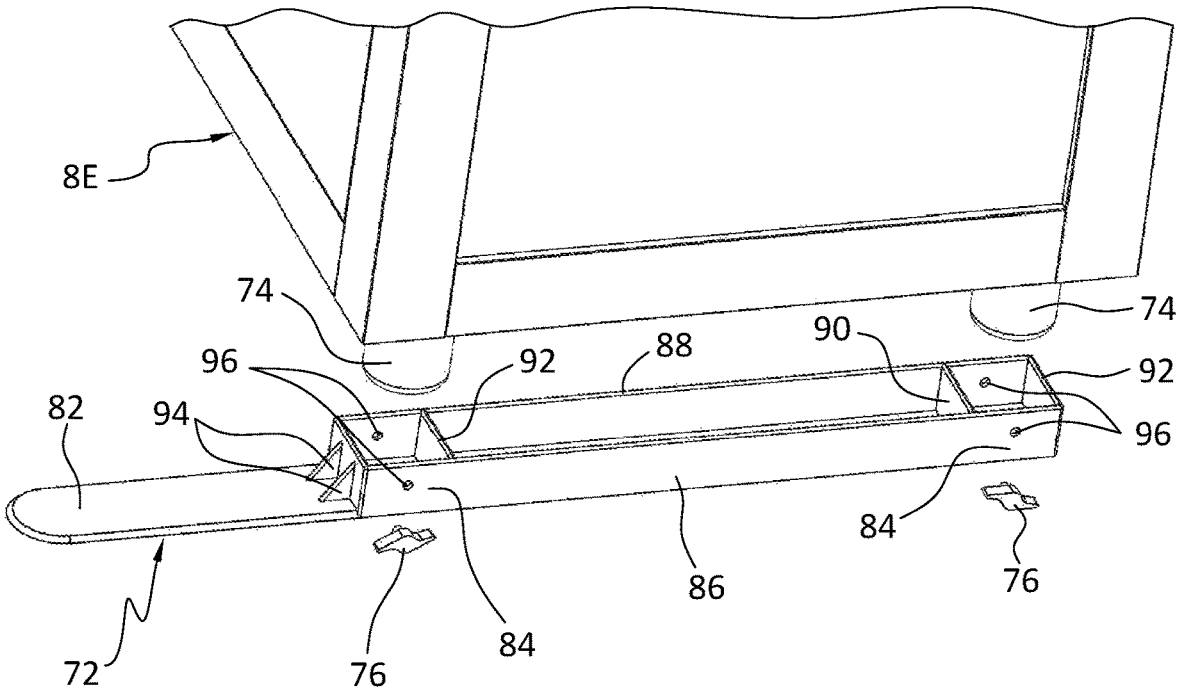
FIG. 17 is a view of the anti-tipping mechanism of FIG. 16.
Figure 18:
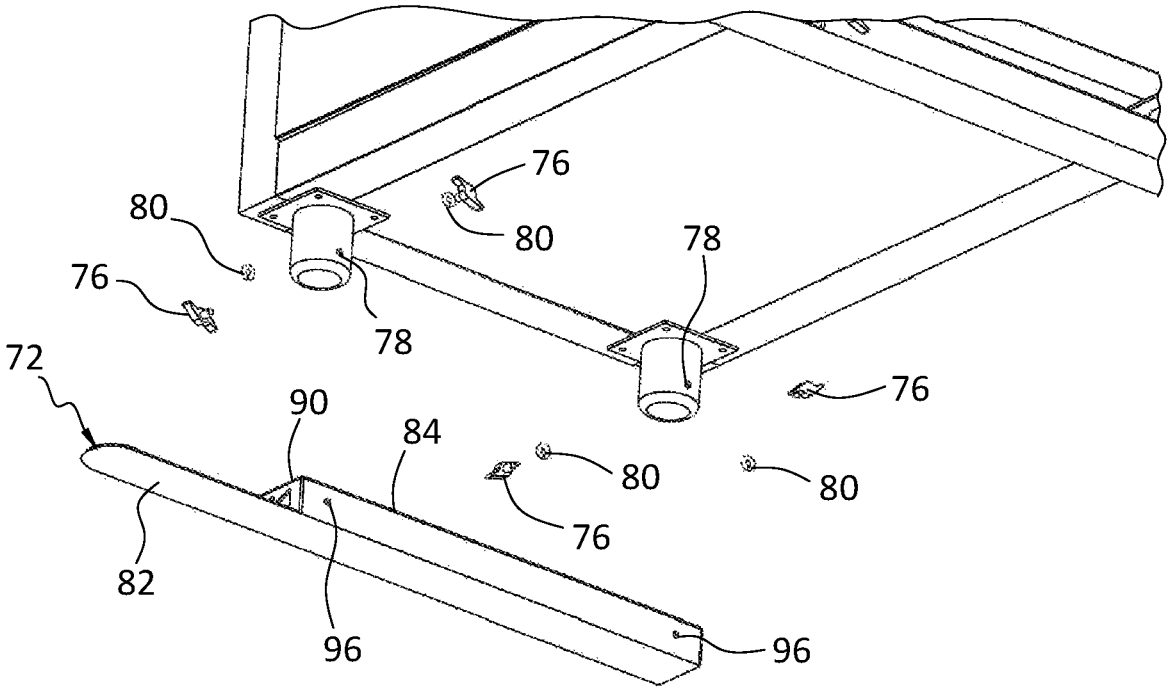
FIG. 18 is a bottom perspective view showing attachment of the anti-tipping mechanism of FIGS. 16 and 17 in connection with legs of a dresser having apertures.

FIGS. 16-18 show another embodiment of a mechanism for preventing tipping of a dresser 8E which includes a boot 72 attached to the forward and rearward (front and back) support legs 74.

Boot 72 are mountable to the outside of the support legs 74, the inside of the support legs 74 and secured with tightening wing nuts 76 that either tighten flush to the support legs 74 (FIGS. 16 and 18) or even more positively, enter corresponding holes 78 in the support legs 74 that mate up with the thread of the wing nut screw which provide further insurance that the boots 72 are securely in place (such holes 78 being shown in FIG. 18). Lock washers 80 may be provided between the wing nuts 76 and the surfaces of the boots 72 (FIG. 18) for positive lock tight engagement.

Each boot 72 includes a bottom portion 82 that is configured to include an extension portion which extends forward of the front support leg 74 and retaining structure 84 to retain each support leg 74 that interacts with the boot 72 (two retaining structure 84 in the illustrated embodiment). Each retaining structure 84 includes one or more walls that cooperate to surround the support leg 74 and provide access to the wing nut 76 to enable it to be tightened against the support leg 74 through holes 78. The boot 72 has a bottom flange portion extending laterally from a first location of the forward retaining structure 84, this location being the location at which a portion of the support leg 74 is received by the retaining structure 84.

The retaining structure 84 may include an outside vertical wall 86 extending upward from the bottom portion 82 and an inside vertical wall 88 extending upward from the bottom portion 82 a distance from the outside vertical wall 86 that is equal to or slightly larger than the thickness of the support leg 74 to be retained by the retaining structure 84. The outside wall is that wall that will be seen from a side view of the dresser 8E. The boots 72 are generally symmetric.

Lateral walls 90, 92 are also provided extending between the inside and outside vertical walls 88, 86, spaced apart a distance that is equal to or slightly larger than the thickness of the support leg 74 to be retained by the retaining structure 84. Instead of four walls, an alternative number of walls may be provided, e.g., a single circular wall or six walls forming a hexagon.

One or more reinforcement ribs 94 may be provided between the forwardmost lateral wall 90 of the forwardmost retaining structure 84 and the extension portion of the bottom portion 82. Lateral walls 86, 88 also include holes 96 for the wing nuts 76, see FIG. 17, and that align with the holes 78 in the support legs 74 if present (see FIG. 18). It is possible to form an extension without the rear wall 92 of the forward retaining structure 84 and without the forward wall 90 of the rear retaining structure 84.

Removal of the boot 72 from engagement with the support legs 74 is possible by turning the wing nuts 76 and releasing their pressing force against the support legs 74.

The presence of the extension portion of the bottom portion 82, forward of the front leg, functions in the same manner as described above with respect to FIGS. 1-11A. The size of the extension portion of the bottom portion 82 may also be as described above for the extension portions of the boots 12, 32, 52.

Figure 19:
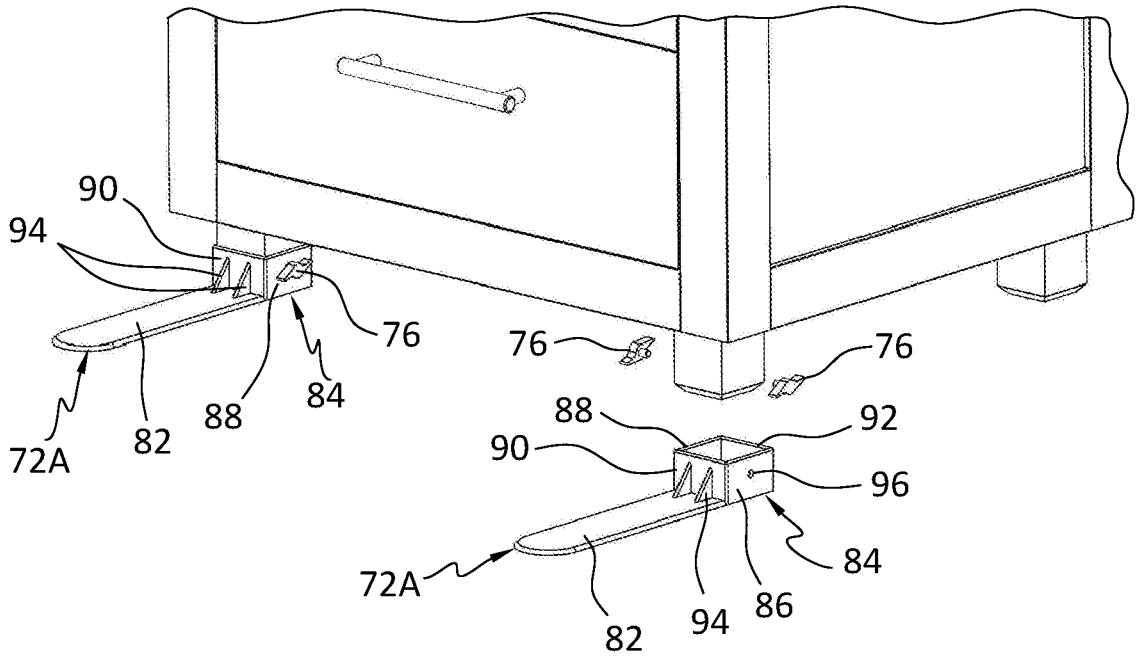
FIG. 19 is a front perspective view of part of a dresser including another embodiment of an anti-tipping mechanism in accordance with the invention.

FIGS. 16-18 show an embodiment wherein the boot 72 is designed to accept two support legs 74, one in the front of the dresser 8E and one in the rear of the dresser 8E behind the front support leg 74. By contrast, FIG. 19 shows an embodiment wherein the boot or boot 72A is designed to accept only a single support leg 74 in the front of the dresser 8E. A therefore includes only a single retention structure 84.

Wing nuts 76 may be considered tightening means that serve to tighten the boot 72 (or 72A) to the support leg 74. Other comparable tightening structure may be used. The tightening structure or means may depend on which the support legs 74 of the dresser 8E have holes 78 or not. If there are no holes 78, then the tightening means should be designed to press against the support legs 74, so that when pressed in opposite direction by tightening means on opposite sides of the support legs 74, the support legs 74 are secured in connection with the boot 72 (or 72A). Holes 78 aid in the retention and securing of the boot 72 (or 72A) to the support legs 74.

The tightening means used may also depend on the shape of the support legs 74, e.g., whether they are circular (FIGS. 16-18) or have flat lateral sides (FIG. 19). Support legs 74 may be round as in some embodiment or square. When square, the holes in the support legs 74 may be eliminated.

Figure 20:
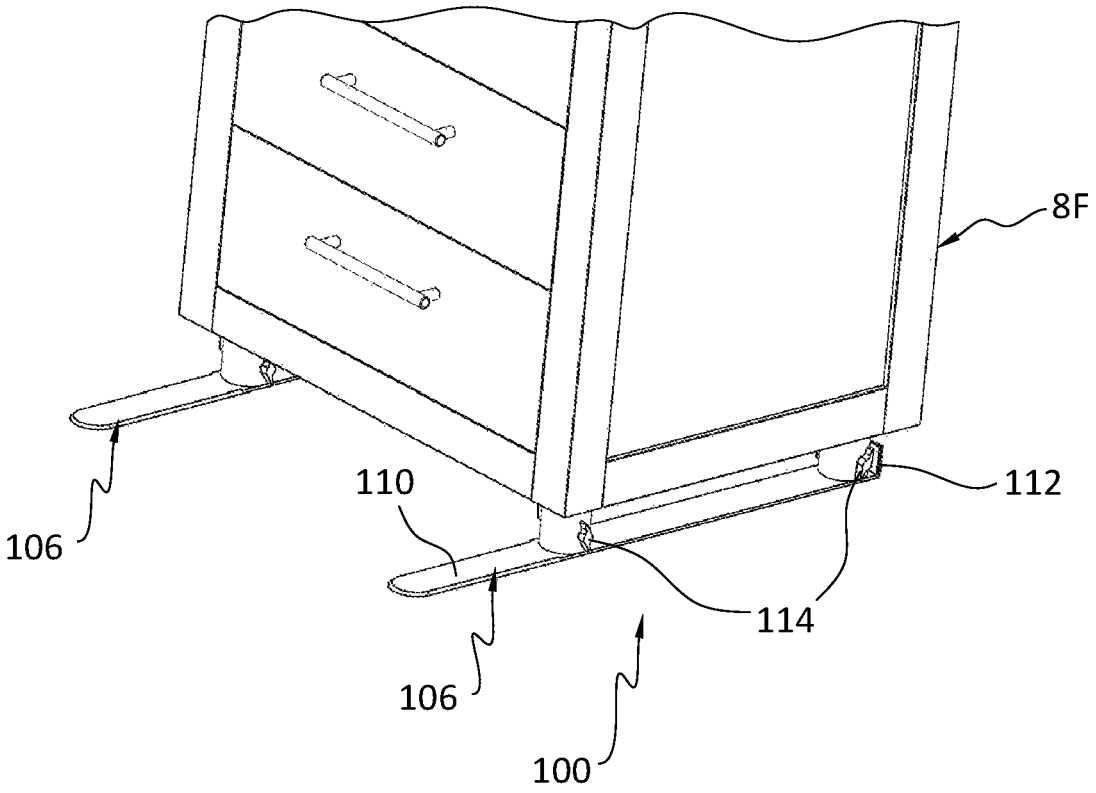
FIG. 20 is a view showing the bottom of a dresser including another embodiment of an anti-tipping mechanism in accordance with the invention.
Figure 21:
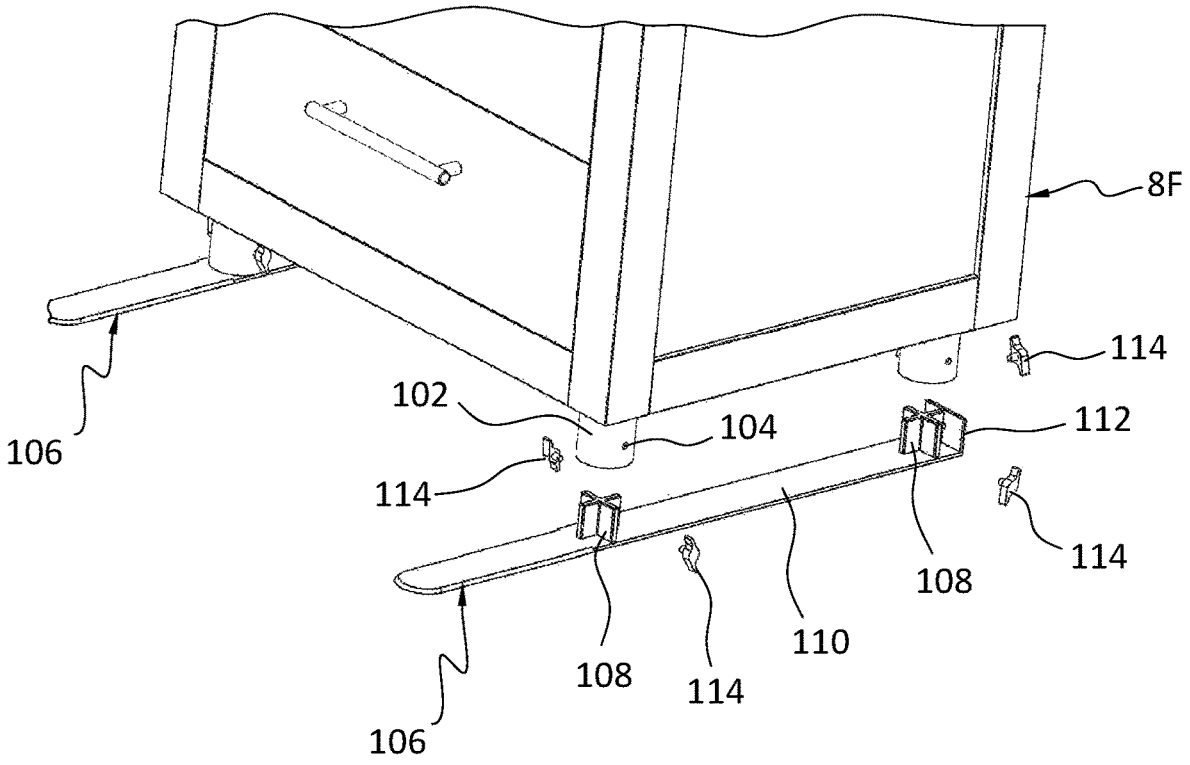
FIG. 21 is a view of the dresser shown in FIG. 20 with the anti-tipping mechanism detached from the dresser.
Figure 22:
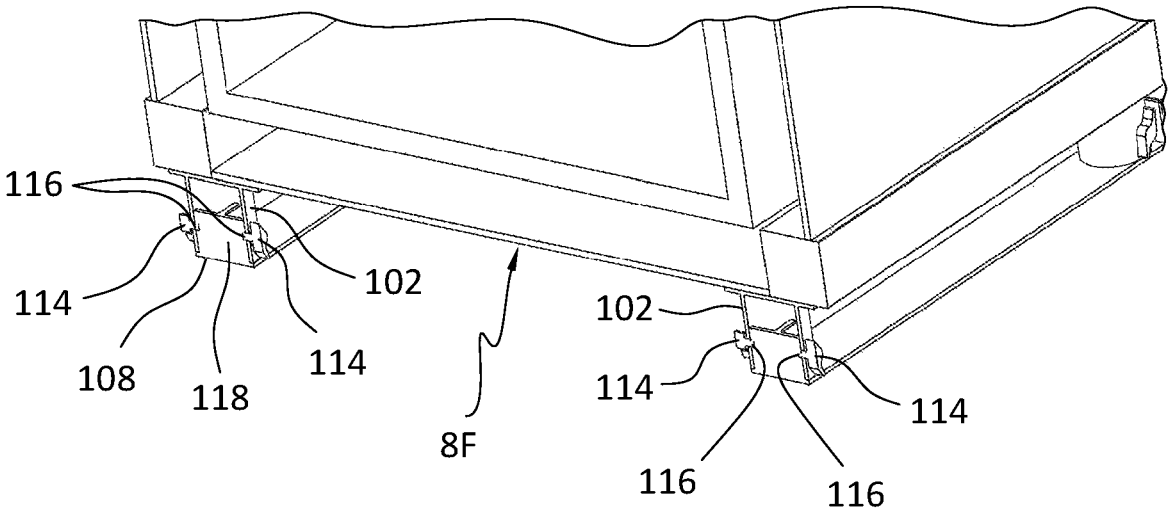
FIG. 22 is a sectional view of FIG. 21 showing the engagement between the dresser and the anti-tipping mechanism.

FIGS. 20-22 show an embodiment of an anti-tipping mechanism 100 in accordance with the invention which is used with a dresser 8F having hollow support legs 102 and holes 104 extending through the peripheral wall of the support leg 102 into the hollow interior of the support leg 102. Anti-tipping mechanism 100 includes a boot or extension 106 having an elevated placement structure 108 as a retention structure for each support leg 102. Each elevated placement structure 108 extends upward from a bottom portion 110 of the boot 106 and that is configured to fit within the hollow interior of the support leg 102.

The elevated structure 108 may include a plurality of intersecting walls, e.g., two walls intersecting at a 90 degree angle (perpendicular to one another in the shape of an +). For this embodiment, only a rearmost lateral wall 112 is provided to assist in positioning of the boot 106, although even rearmost lateral wall 112 should be considered optional. Other lateral walls may be provided to aid in positioning of the support legs 102 on the boot 106, i.e., so that each hollow interior of the support legs 102 receives a respective elevated structure 108.

The elevated structure 108 is configured so that the holes 104 in the support legs 102 align with one of the walls thereof so that the wing nuts 114 when inserted through the holes 104, press against the wall and tighten the support leg 102 to the elevated structure 108, or enter into aligning holes 116 in the walls 118 to provide a tightening effect (see FIG. 22).

The boots 72 (FIGS. 16-18), 72A (FIG. 19), 106 (FIGS. 20-22) ideally will be constructed in substantially unbreakable injection molded substrates such as Acetal (DELRIN), Polycarbonate (LEXAN), and even ABS (which is used to make crash helmets). While it is strong and reasonably rigid, the inventors feel that even a little flex in the boot 72, 72A, 106 can further assist in resisting tip-ability.

Currently, a 9 inch boot 72 (FIGS. 16-18), 72A (FIG. 19), 106 (FIGS. 20-22) of a drawer that might open up fully to 12 or 13 inches should be sufficient. However, it is contemplated that the portion of the boot 72, 72A, 106 extending beyond the front surface of the dresser may be as long as that of the drawer opening or even longer.

The boot 72 (FIGS. 16-18), 72A (FIG. 19), 106 (FIGS. 20-22) can be as thin as ⅛ inches, i.e., the thickness of the bottom portion thereof, and soft round to the edge, i.e., at least the front edge, to prevent possible tripping. Because it is thin, it is ideal to consider placing a carpet on top of the left and right boots 72, 72A, 106 to thus hide the boots 72 (FIGS. 16-18), 72A (FIG. 19), 106 (FIGS. 20-22) and at the same time insure there will be no tripping. The carpet may also serve to assist the dresser from moving, as well.

The foregoing anti-tipping mechanisms generally relate to additional structure to attach to the furniture in order to increase the anti-tipping resistance of the dresser without requiring any modifications to the furniture, or only nominal modifications, e.g., making holes in the support legs. These attachments are easily removed from the furniture, e.g., for moving the furniture. The invention also encompasses modifications to furniture itself used in combination with additional structure.

The following embodiments relate to anti-tipping mechanisms that involve modification to a piece of furniture to provide for two cooperating parts that are engaged with one another to secure the furniture to a support structure, one part being attached to or integral with the support structure and the other part being attached to or integral with the furniture.

In a first such embodiment shown in FIGS. 23-26, the first part is a rigid wall bracket 132 having a central planar portion 134 and side flanges 136 in a common plane with one another but in a different plane than the planar portion 134. The central planar portion 134 may be a flat piece of material with opposing planar sides or surfaces. There is one side flange 136 on each side of the central portion 134. The side flanges 136 may each be a flat piece of material with opposing planar sides or surfaces. The thickness of the planar portion 134 and the side flanges 136 is selected to provide the desired rigidity. The planar portion 134 and the side flanges 163 may be formed from a unitary or integral piece of material.

The distance from planar portion 134 to side flanges 136 ideally is the depth of the head of a carriage bolt 140, so when the bracket 132 is mounted to the wall 138 the carriage bolt square member aligns perfectly with that of the square hole in the bracket 132 and will stay perfectly in place when engaged by the wingnuts 148 inside the dresser 144. The square member engages the square opening and resists rotation. This provides a positive engagement when tightening the dresser 144 to the wall 138 when tightening it with the wingnuts 148. If the head of the carriage bolt 140 is about ⅛ inches, then the distance from inside the planar portion 134 to that of the side flanges 136 should be substantially the same. If the gap is too large, the carriage bolt 140 will want to disengage the square hole.

Although a carriage bolt 140 is mentioned, the bolt does not have to be a carriage bolt and may be any type of bolt, e.g., a welded bolt, or possibly even just a screw or other type of threaded elongate member.

The side flanges 136 include one or more apertures through which a respective number of screws are passed to attach the bracket 132 to the support structure, i.e., a vertical wall 138. When the bracket 132 is attached to the vertical wall 138, the side flanges 136 will be against the vertical wall 138, either directly or indirectly in contact therewith, while the central portion 134 will be spaced apart from the vertical wall 138 (see FIG. 24).

The structure of the screws (or carriage bolt to connect the bracket to the wall) and apertures, and number of screws that should be provided will be obvious to those skilled in the art to which this invention pertains in view of the disclosure herein. Instead of screws and apertures, other attachment means may be used. Bracket attachment means will therefore mean any structure that provides for a secure attachment of one part to another part (secured or part of a stationary or difficult to move structure) and prevents separation of that part from the other part when a force is exerted to that part. Those skilled in the art to which this invention pertains will readily ascertain other suitable bracket attachment means.

Figure 23:
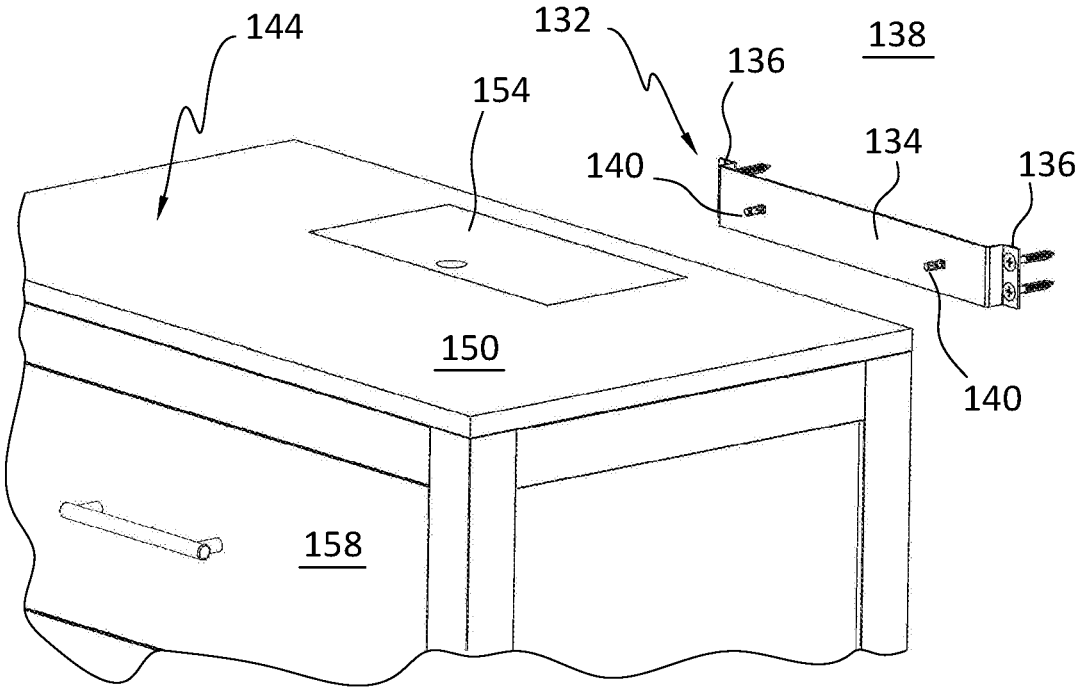
FIG. 23 is a partial perspective view of another embodiment of an anti-tipping mechanism in accordance with the invention having a part integrated into a dresser.

The bracket 132 includes two carriage bolts 140 that project from the central portion 134 to the side away from the side flanges 136 (see FIG. 23). Although two carriage bolts 140 are shown, there may be a different number of carriage bolts 140. The carriage bolts 140 may be passed from behind through an aperture in the bracket 132 to project outward from the bracket 132. The manner in which the carriage bolts 140 may be attached to the bracket 132 are readily ascertainable by those skilled in the art to which this invention pertains. A threaded projection may also be formed integral with the bracket 132 if so desired instead of using carriage bolts 140.

Figure 24:
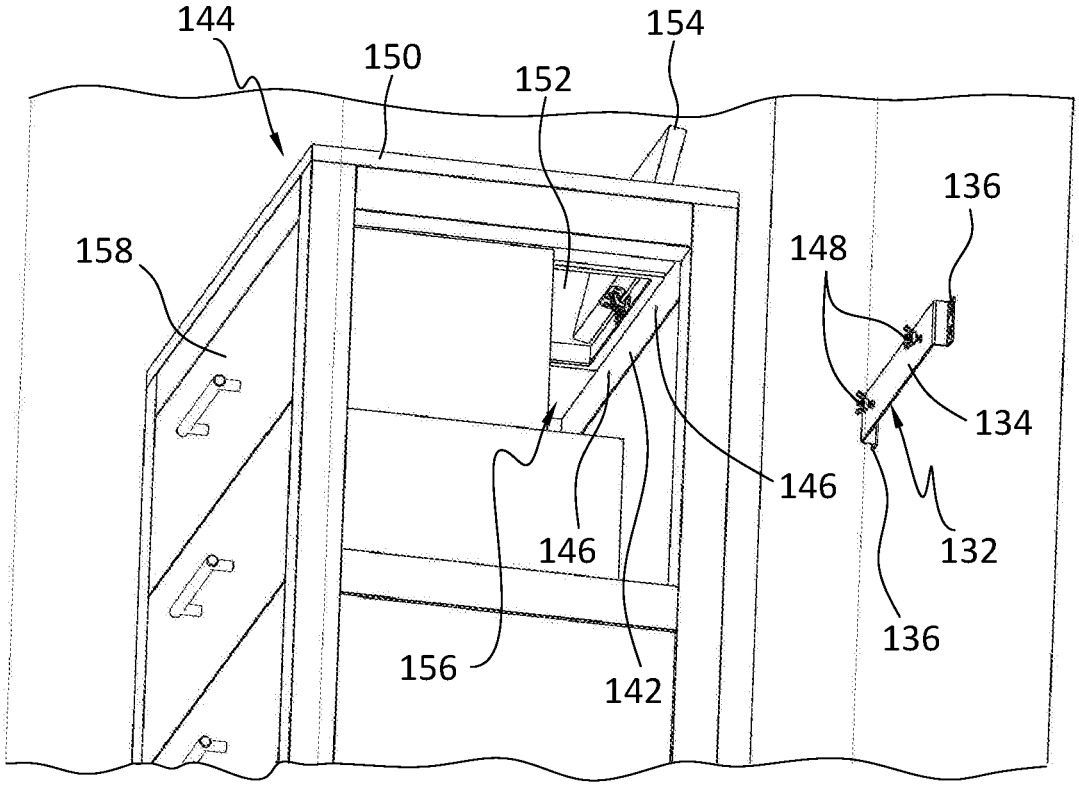
FIG. 24 is a side perspective view of the anti-tipping mechanism in accordance with the invention shown in FIG. 23 with the side panel of the dresser removed.

The second part of the anti-tipping mechanism is a wall section 142 of the dresser 144 that has apertures 146 configured to accommodate the number, pattern, size and location of the carriage bolts 140 of the bracket 132 (see FIG. 24). The thickness of the wall section 142 is less than the height of the carriage bolts 140 to provide for a portion of the carriage bolts 140 extending beyond the wall section 142.

There may be more apertures 146 in the wall section 142 than carriage bolts 140 of the bracket 132, which may be useful if there are different brackets used with different numbers, patterns, sizes and locations of carriage bolts 140. That is, the wall section 142 may be provided with apertures 146 whereby different sets of apertures 146 match different configurations of carriage bolts 140 on different brackets 132.

In the illustrated embodiment, the wall section 142 includes two apertures 146 configured to receive the two carriage bolts 140 (see FIG. 24). As such, it is possible to position the dresser 144 so that the carriage bolts 140 extend through the apertures 146.

The anti-tipping mechanism then also includes wing nuts 148 adapted to the carriage bolts 140 (see FIG. 24 wherein the wing nuts 148 are threaded onto the carriage bolts 140). The wing nuts 148 are threaded onto the carriage bolts 140 after the carriage bolts 140 are passed through the apertures 146. The wing nuts 148 are then tightened to secure the wall section 140 to the bracket 132, and thus the dresser 144 to the wall 138 (see FIG. 25). To aid this, the dresser 144 is first pushed as far as possible against the bracket 132.

When the wall section 132 is secured against the bracket 132, the dresser 144 is thereby secured to the vertical wall 138 and tipping of the dresser 144 is prevented.

Figure 25:
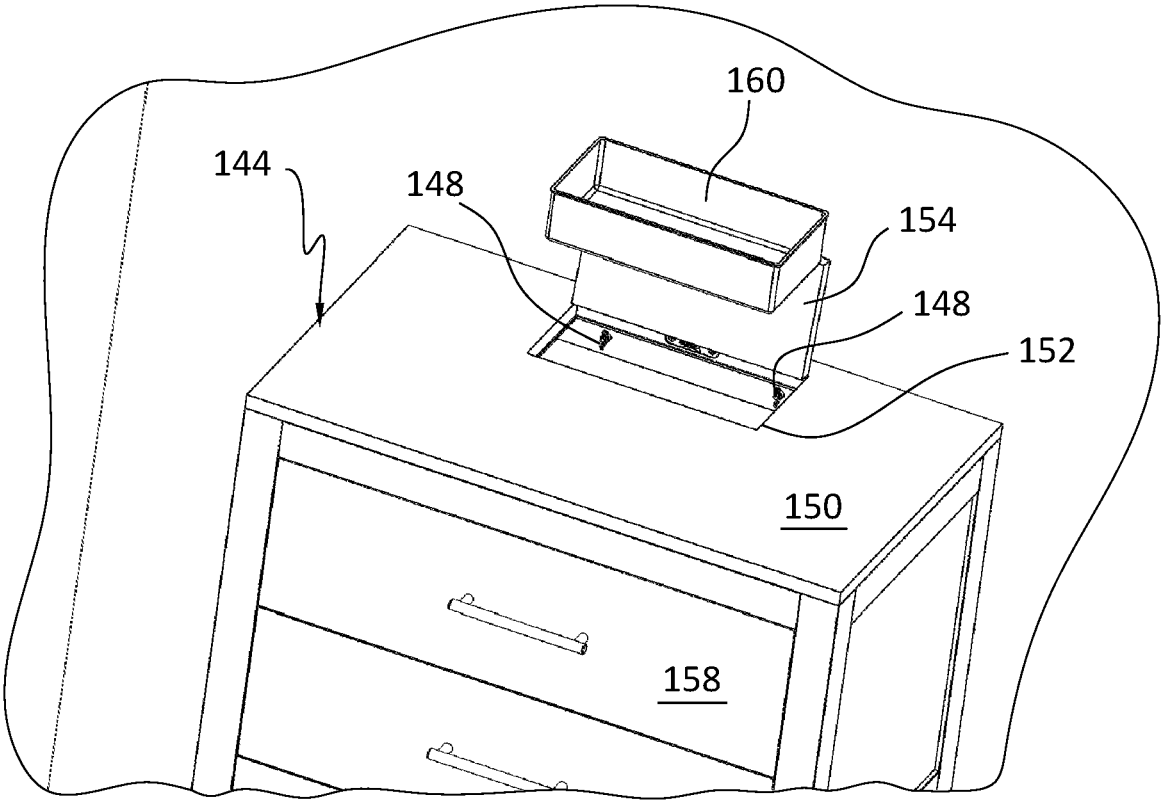
FIG. 25 is a perspective view of the anti-tipping mechanism in accordance with the invention shown in FIG. 23 with a utility tray removed through an open access door.

To enable the wing nuts 148 to be threaded onto the carriage bolts 140 and then tightened, an upper panel 150 of the dresser 144 is provided with an opening 152 into which an access door 154 fits (see FIGS. 24 and 25). Access door 154 is pivotally attached to the upper panel 150 by a hinge to enable opening and closing of the access door 154 in order to access the space 156 underneath the upper panel 150 (see FIG. 24). When the access door 154 is in the closed state, it may be flush with the remaining portion of the upper surface of the upper panel 150.

This space 156 is formed by appropriately dimensioning the depth of the upper drawer 158 of the dresser 144, e.g., to be slightly less than the depth of the lower drawers in the dresser 144 (see FIG. 24). This lesser drawer depth enables the bracket 132 to avoid interfering with drawer operation. If multiple drawers are provided at the top of the dresser 144, then only those drawers that will be in front of the bracket 132 may be made with the lesser depth.

A utility tray 160 may be provided to insert into the space 156 and obstructs viewing of the wall section 142 when the access door 154 is open (see FIG. 25). The utility tray 160 has a depth that is dimensioned to avoid interfering with the upper drawer 158 and rests on one or more flanges formed on surfaces defining the opening 152.

Figure 26:
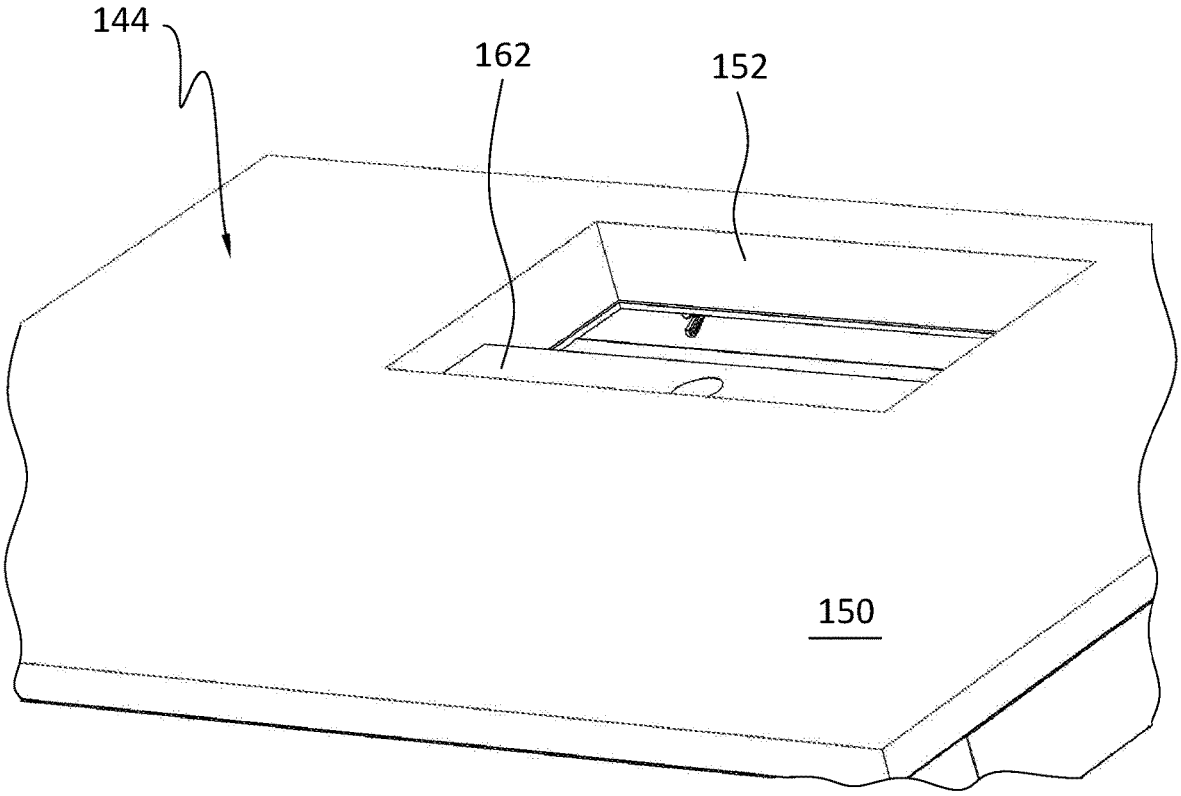
FIG. 26 is a perspective view of the anti-tipping mechanism in accordance with the invention shown in FIG. 23 with a sliding access door.

Instead of a pivoting access door 154, it is also possible to provide a sliding access door 162 as shown in FIG. 26. The sliding access door 162 is provided by mounting sliding tracks on the dresser 144 and the access door 152. One skilled in the art would readily ascertain how to install such sliding doors in view of the disclosure herein.

In an exemplifying use, installation of the anti-tipping mechanism involves first placing the dresser 144 against the wall 138, opening the access door 154, removing the utility tray 160 if present and then tracing through the apertures 146 onto the vertical wall 138. The dresser 144 is then moving away from the wall 138. The carriage bolts 140 are attached to the bracket 132 if not already attached thereto. The bracket 132 is then positioned such that the carriage bolts 140 align with the markings on the wall 138, and then secured to the wall by passing the screws through the apertures in the side flanges 136 of the bracket 132. The wing nuts 148, if present on the carriage bolts 140, are removed and the dresser 144 is then repositioned against the bracket 132, pushing the wall section 142 as far as possible against the bracket 132 while the carriage bolts 140 extend through apertures 146. While the access door 154 is open and the utility tray 160 removed, access to the space 156 is possible and the wing nuts 148 are then threaded onto the carriage bolts 140 and tightened. The optional utility tray 160 is placed into position and the access door 154 is then closed. The dresser 144 is now prevented from tipping.

FIGS. 27-30 show a variant of the embodiment of FIGS. 23-26 wherein a different wall bracket, designated 172 is used. Wall bracket 172 has a central planar portion 174 and side flanges 176 in a common plane with one another but in a different plane than the planar portion 174. Wall bracket 172 is wider than wall bracket 132, but the width of a wall bracket may be varied as desired. There is one side flange 176 on each side of the central portion 174. The side flanges 176 include bracket attachment means as defined above, e.g., one or more apertures, two as shown, through which a respective number of screws are passed to attach the bracket 172 to the vertical wall 138. When the bracket 172 is attached to the vertical wall 138, the side flanges 176 will be against the vertical wall 138, either directly or indirectly in contact therewith, while the central portion 174 will be spaced apart from the vertical wall 138 (see FIG. 27).

Figure 27:
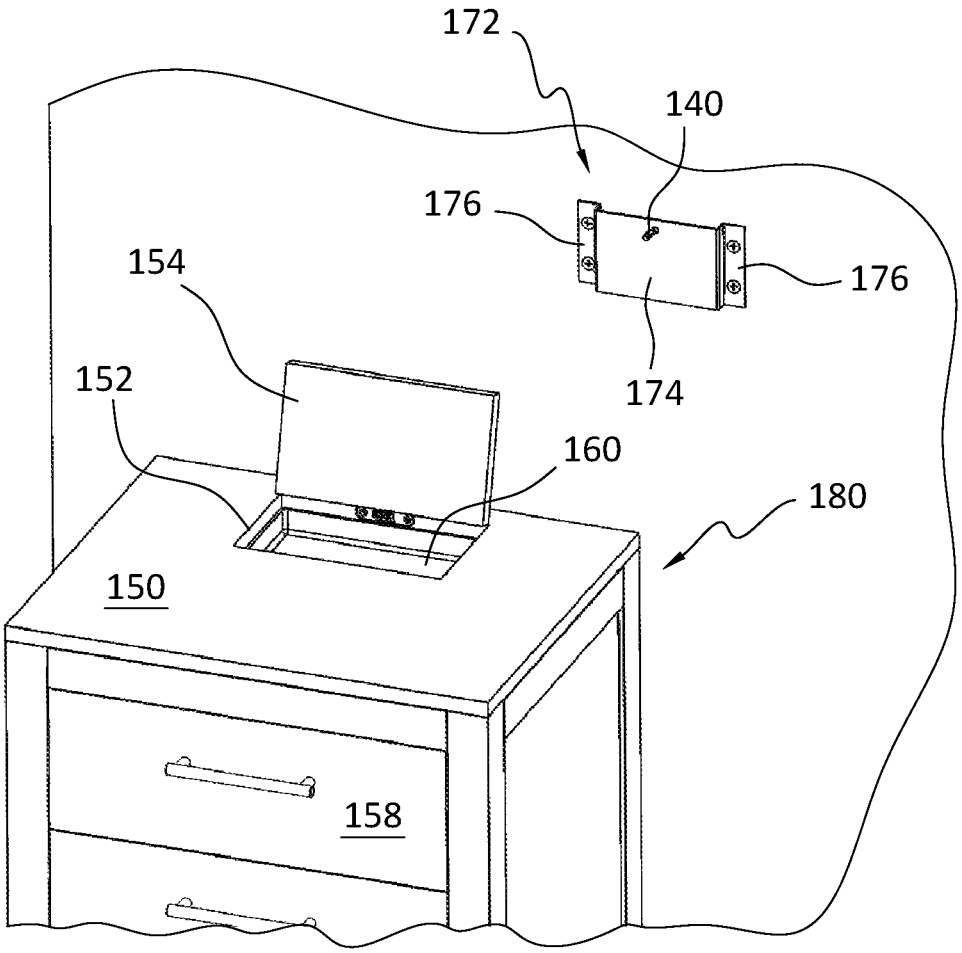
FIG. 27 is a partial perspective view of an anti-tipping mechanism in accordance with the invention having a part integrated into a dresser.
Figure 29:
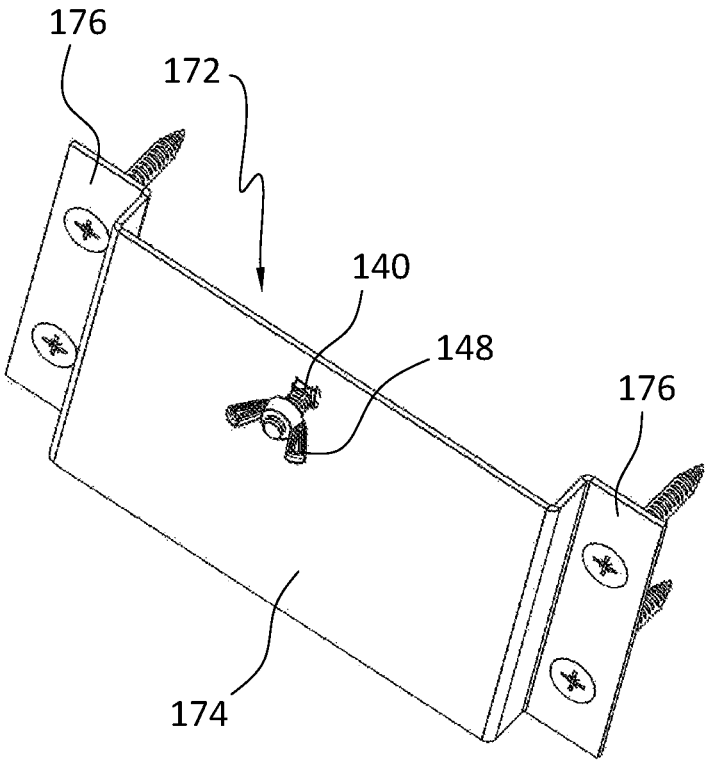
FIG. 29 is a view of the bracket for the anti-tipping mechanism of FIG. 27.
Figure 30:
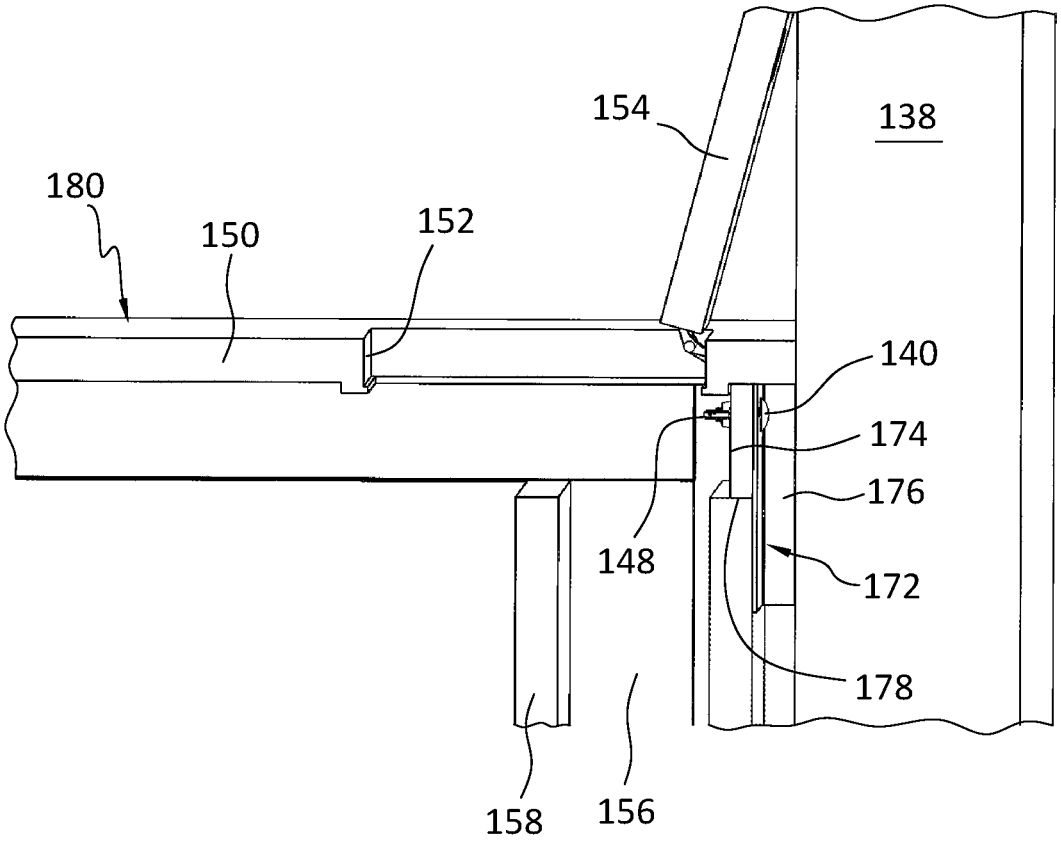
FIG. 30 is a cross-sectional view through the anti-tipping mechanism of FIG. 27.

The bracket 172 includes one carriage bolt 140 that project from the central portion 174 to the side away from the side flanges 176 (see FIGS. 27 and 29). Although one carriage bolt 140 is shown, there may be more than one carriage bolt 140. The carriage bolt 140 may be passed from behind through an aperture in the bracket 172 to project outward (in the forward direction) from the bracket 172. A threaded projection may also be formed integral with the bracket 172 if so desired instead of using carriage bolt 140.

Figure 28:
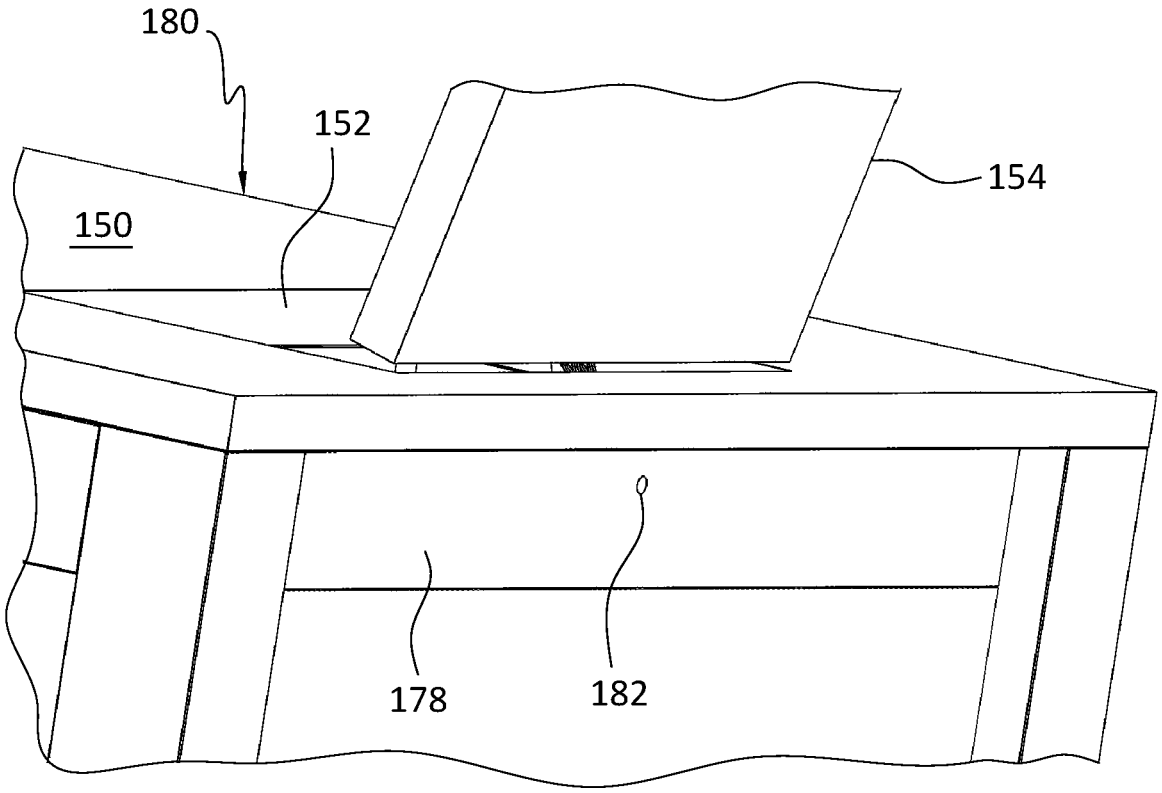
FIG. 28 is a rear view of the dresser of FIG. 27.

The second part of the anti-tipping mechanism is a wall section 178 of the dresser 180 that has an aperture 182 configured to accommodate the carriage bolt 140 of the bracket 172 (see FIG. 28). The thickness of the wall section 178 is less than the height of the carriage bolt 140 to provide for a portion of the carriage bolt 140 extending beyond the wall section 178.

There may be more apertures 182 in the wall section 178 than the number of carriage bolts 140 of the bracket 172, which may be useful if there are different brackets used with different numbers, patterns, sizes and locations of carriage bolts 140. That is, the wall section 178 may be provided with apertures 182 whereby different sets of one or more apertures 182 match different configurations of carriage bolts 140 on different brackets 172.

In the illustrated embodiment, the wall section 178 includes a single aperture 182 configured to receive the single carriage bolt 140 (see FIG. 28). As such, it is possible to position the dresser 180 so that the carriage bolt 140 extends through the apertures 182.

The anti-tipping mechanism also includes a wing nut 148 adapted to the carriage bolt 140 (see FIG. 29 wherein the wing nut 148 is threaded onto the carriage bolt 140). The wing nut 148 is threaded onto the carriage bolt 140 after the carriage bolt 140 is passed through the aperture 182. The wing nut 148 is then tightened to secure the wall section 178 to the bracket 172 (see FIG. 30). To aid this, the dresser 180 is first pushed as far as possible against the bracket 172.

When the wall section 178 is secured against the bracket 172, the dresser 180 is thereby secured to the vertical wall 138 and tipping of the dresser 180 is prevented.

Wall section 178 may be dimensioned to avoid interfering with the opening of the upper drawer so that the upper drawer can have the same depth as the remaining drawers in the dresser 180. To this end, the installer of the anti-tipping mechanism must measure the location on the vertical wall 138 to install the bracket 172.

FIGS. 31-34 show another variant of the embodiment of FIGS. 23-26 wherein a different wall bracket, designated 192 is used. Wall bracket 192 has a central planar portion 194 and side flanges 196 in a common plane with one another but in a different plane than the planar portion 194. Wall bracket 192 is wider than wall bracket 132, but the width of a wall bracket may be varied as desired.

The central planar portion 194 may be a flat piece of material with opposing planar sides or surfaces. There is one side flange 196 on each side of the central portion 194. The side flanges 196 may each be a flat piece of material with opposing planar sides or surfaces. The thickness of the planar portion 194 and the side flanges 196 is selected to provide the desired rigidity. The planar portion 194 and the side flanges 196 may be formed from a unitary or integral piece of material.

The side flanges 196 include bracket attachment means as defined above, e.g., one or more apertures, two as shown, through which a respective number of screws are passed to attach the bracket 192 to the vertical wall 138. When the bracket 192 is attached to the vertical wall 138, the side flanges 196 will be against the vertical wall 138, either directly or indirectly in contact therewith, while the central portion 194 will be spaced apart from the vertical wall 138 (see FIG. 31).

Figure 31:
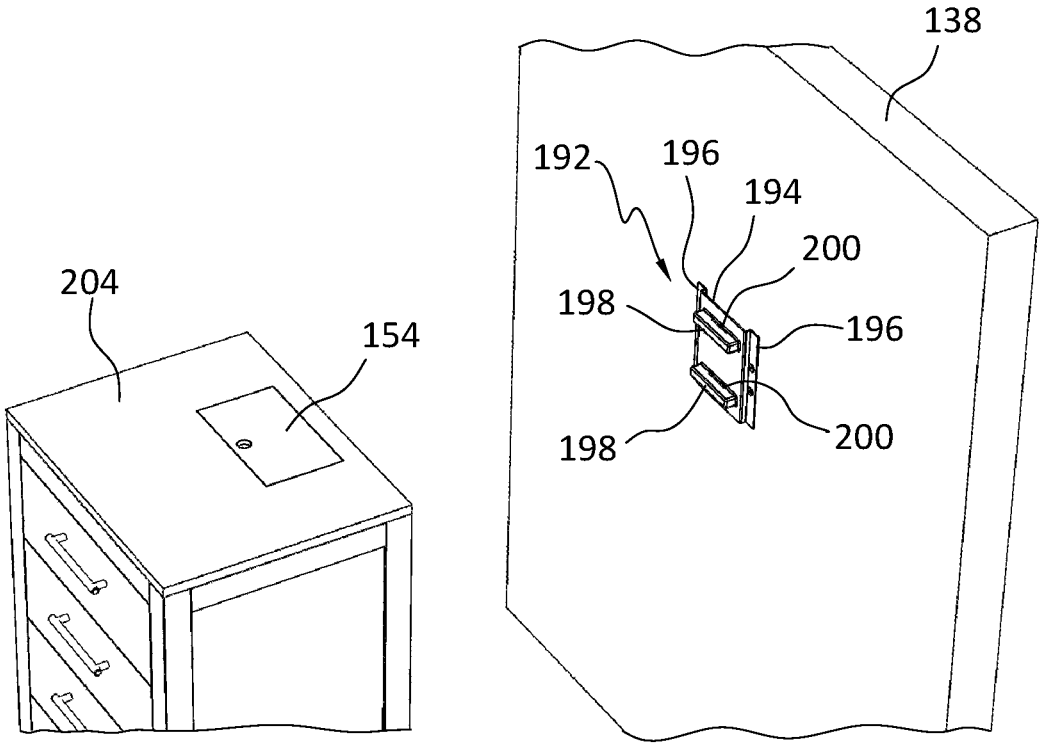
FIG. 31 is a partial perspective view of another embodiment of an anti-tipping mechanism in accordance with the invention having a part integrated into a dresser.

The bracket 192 includes two projections 198 that project from the central portion 194 to the side away from the side flanges 196 and are spaced apart from one another (see FIG. 31). Although two projections 198 are shown, there may be a different number of projections 198. Each projection 198 may be formed separate from the central portion 194 and then attached thereto or formed integral or as a unit with the central portion 194 from the same material. The projections 198 are elongate and may be parallel to one another.

Each projection 198 includes a slot 200 (see FIG. 31). In a preferred embodiment, the slot 200 is formed close to the central portion 194 and at the same position on all of the projections 198 present on the central portion 194. Each slot 200 is elongate and extends from an upper surface of the projection 198 through the projection 198 to a lower surface of the projection 198. Other shapes of slots are also possible, but each slot must pass through the projection 198 between the upper and lower surfaces.

Figure 32:
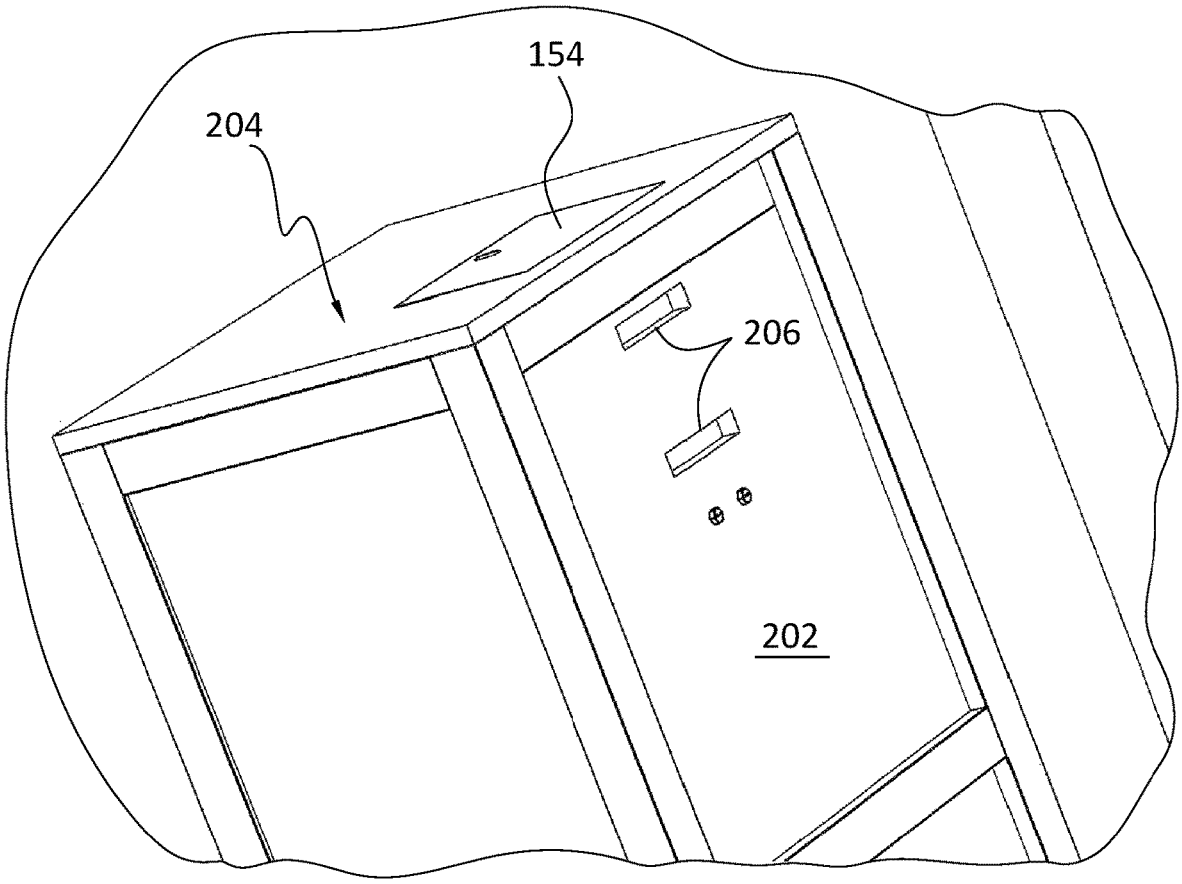
FIG. 32 is a rear view of the dresser of FIG. 31.

The second part of the anti-tipping mechanism is a wall section 202 of the dresser 204 that has elongate apertures 206 configured to accommodate the projections 198 of the bracket 192 (see FIG. 32).

It is important to align the location of the wall bracket 192 in FIG. 31 to mate exactly to the apertures 206 in the wall section 202 shown in FIG. 32. While this can be accomplished in several ways, one possibility would be the use of double faced tape strips placed on the rear of the side flanges 196 of both sides of the bracket 192. The bracket 192 is temporarily placed in the respective aperture 206 in the rear of the dresser 204 and pressed against the wall at the desired location. Removal of the dresser 204 will leave the bracket 192 affixed temporarily to the wall in the properly registered position for permanent marking and subsequent fastening (screwing) to the wall 138. Other methods might consist of protruding marks on the back side of the side flanges 196 and when pressed against the wall 138, the marks will leave indents as precise guides for fastening the bracket 192 and insuring it will mate to the openings 206 on the back of the dresser 204.

Yet another method might be to temporarily engage the bracket 192 into the dresser apertures 206 and carefully place the dresser 204 flush to the desired position. Once in place, the installer can pivot open the access door 154 to carefully pencil-mark the lines through the apertures 206 to that of the wall 138. Once done, you will have proper locations for permanent mounting. While these are a few methods for aligning and registering the bracket 192 to the dresser 204, there are others that will provide similar desired results.

There may be more apertures 206 in the wall section 202 than the number of projections 198 of the bracket 192, which may be useful if there are different brackets used with different numbers, patterns, sizes and locations of projections 198. That is, the wall section 202 may be provided with apertures 206 whereby different sets of one or more projections 198 match different configurations of projections 198 on different brackets 192.

Figure 33:
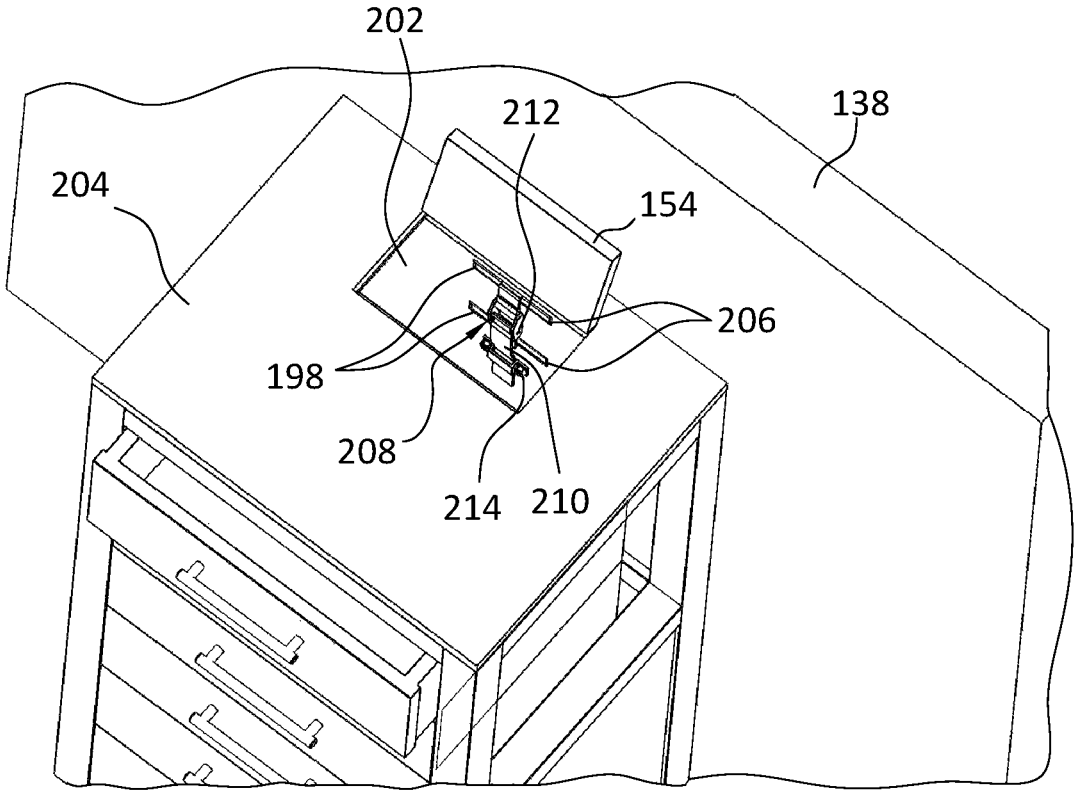
FIG. 33 is a view of the anti-tipping mechanism of FIG. 31 through an access door in the upper panel of the dresser.
Figure 34:
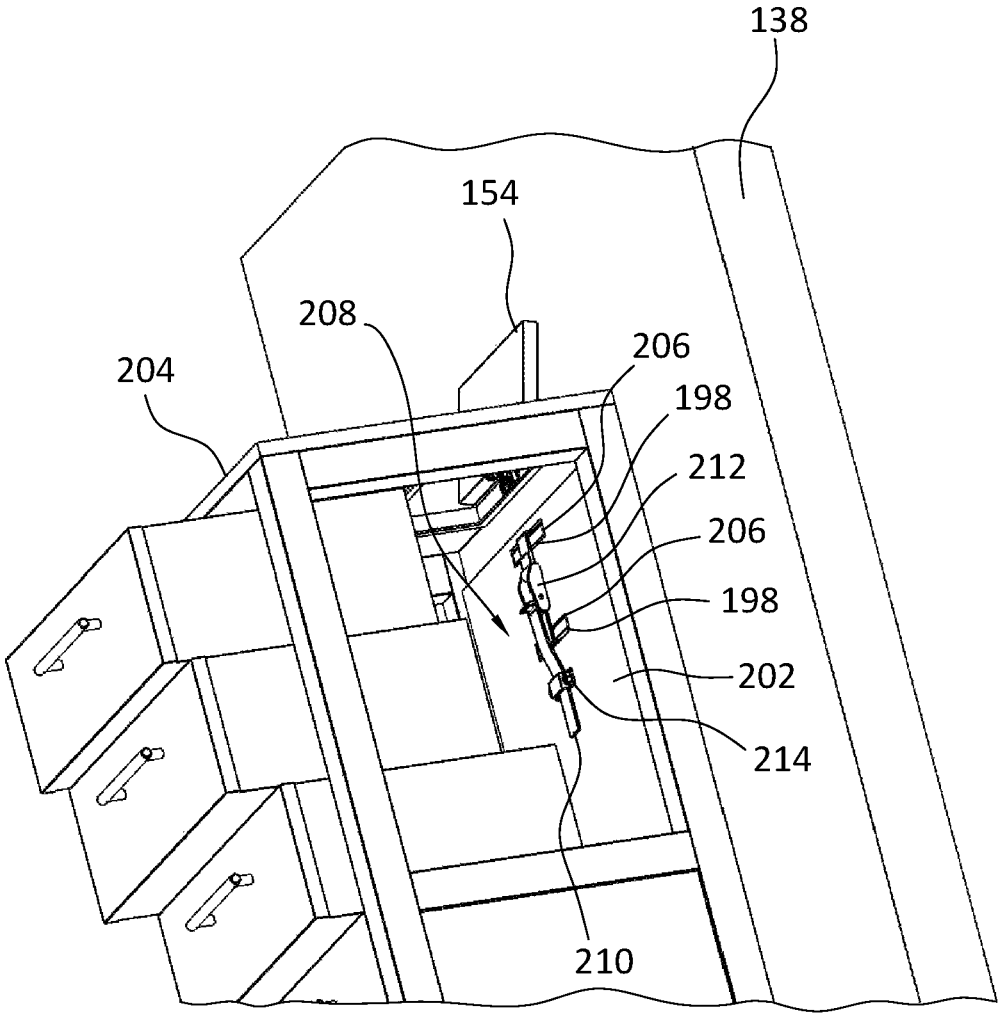
FIG. 34 is a side perspective view of the dresser with the anti-tipping mechanism of FIG. 31 with the side panel of the dresser removed.

In the illustrated embodiment, the wall section 202 includes two apertures 206 each configured to receive a respective one of the projections 198 (see FIGS. 33 and 34). As such, it is possible to position the dresser 204 so that the projections 198 extend into and possibly through the apertures 206.

The anti-tipping mechanism also includes a lashing strap 208 including a strap 210 that is passed through the slots 200 in the projections 198 and a cam-lock buckle 212 engaging with the strap 210. The buckle 212 tightens the strap 210 and releases the strap 210 based on manipulation of the buckle 212. The construction of such buckles 212 and their engagement with a strap 210 is known to those skilled in the art to which this invention pertains. The strap 210 may be made of polyester or NYLON™, or other suitable webbing material. The strap 210 may be pulled downward to tighten the dresser 204 against the wall and once tight, the cam-lock buckle 212 which was open to allow for the tightening is then pushed in a closed locking position. A cam-lock buckle 212 is representative of various similar-function mechanisms, such as a ratchet.

A hold-down bracket 214 is situated on the wall section 202 and is used to retain an excess portion of the strap 210. The hold-down bracket 214 may be positioned a few inches below the lower one of the apertures 206. In addition to the hold-down bracket 214 keeping the excess strap 210 neat, it serves also as that of a secondary security lock to keep the dresser 204 against the wall should the cam-lock buckle 212 become loose for some unforeseen reason such as that of not properly locking it in the first place.

Installation of the anti-tipping mechanism involves first placing the dresser 204 against the wall 138, opening the access door 154, removing the utility tray if present and then tracing through the apertures 206 onto the vertical wall 138. The dresser 204 is then moved away from the wall 138. The bracket 192 is attached to the wall 138 in a position in which the projections 198 align with the markings on the wall 138, and then secured to the wall 138 using the bracket attachment means. Other position marking or alignment techniques may be used as described above.

The strap 210 is passed through the slots 200 in the projections 198 with both ends being free.

The dresser 204 is then repositioned against the bracket 192, pushing the wall section 202 as far as possible against the bracket 192 while the projections 198 extend through the apertures 206 and the upper free end of the strap 210 is passed through the upper one of the apertures 206 and the lower free end of the strap 210 is passed through the lower one of the apertures 206. As such, the ends of the strap 210 are accessible.

While the access door 154 is open and the utility tray 160 removed, the buckle 212 is attached to the strap 210 and tightened, preferably positioning the buckle 212 between the apertures 206. This tightening secures the dresser 204 against the wall 138.

The excess portion of the strap 210 is put into the hold-down bracket 214 (see FIGS. 33 and 34).

The embodiment of FIGS. 31-34 is not limited to the disclosed structure and encompasses other functionally equivalent structure. The general concept of providing a bracket 192 with one or more projections that align with and pass into apertures 206 in the wall section 202 of a piece of furniture and using a strap 210 to secure the projection(s) on the bracket 192 to the wall section 202 is intended to be covered by the embodiment of FIGS. 31-34. Thus, this embodiment covers the use of one or more straps that are guided inside the space defined by the dresser 204 and then into engagement with the wall 138 through one or more apertures 206 in the back of the dresser 204.

There is a tightening mechanism associated with the strap 210 to provide for a tight and secure attachment of the dresser 204 to the wall 138. During installation, the tightening of the lashing strap 208 typically does not cause movement of the dresser 204 but rather the dresser 204 is positioned in its desired place and then the lashing strap 208 is tightened. Any excess portion of the strap 201 may be inserted into the hold-down bracket 214.

Figure 35:
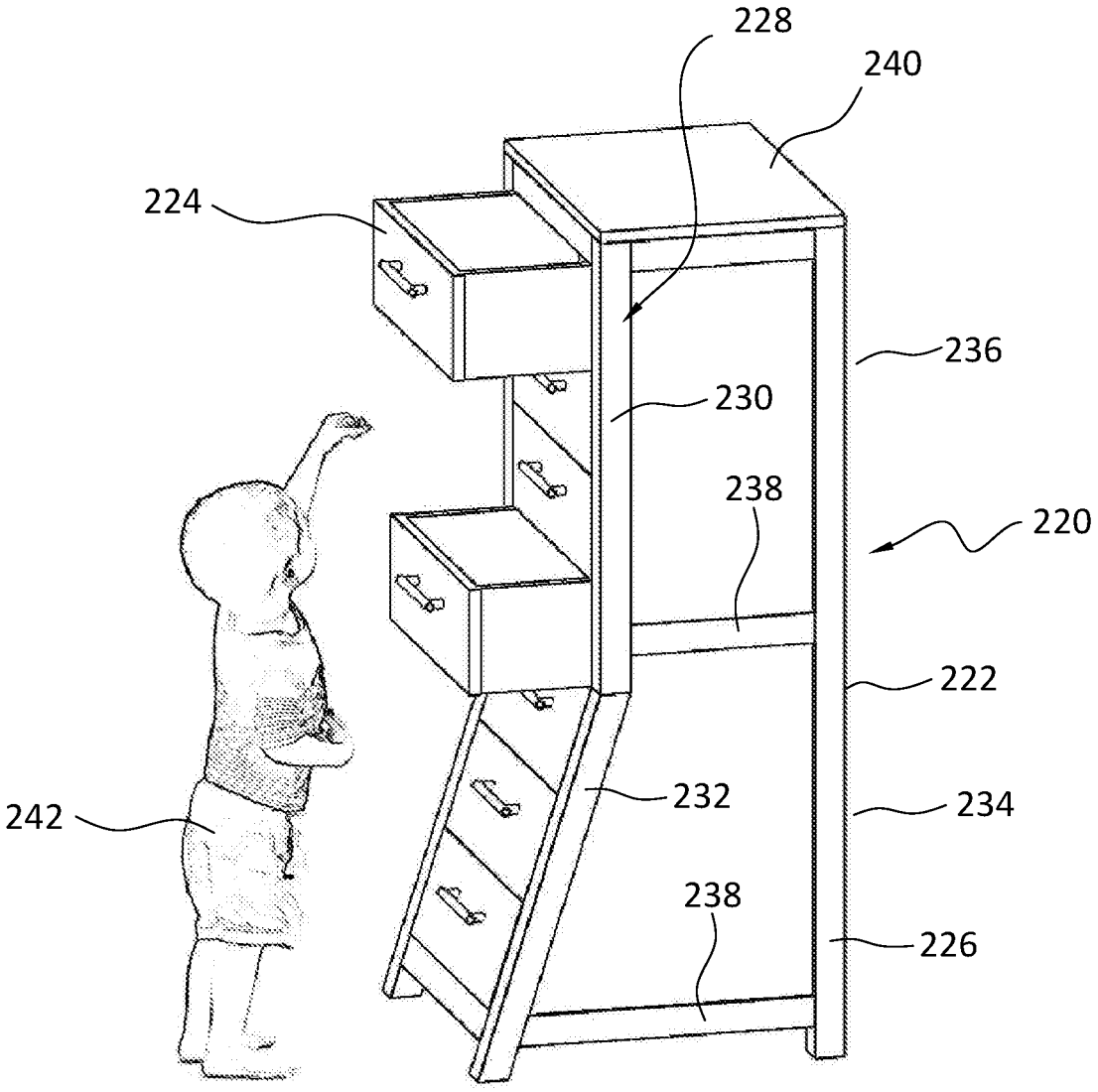
FIG. 35 is a perspective view of an embodiment of a dresser providing anti-tipping properties in accordance with the invention.
Figure 36:
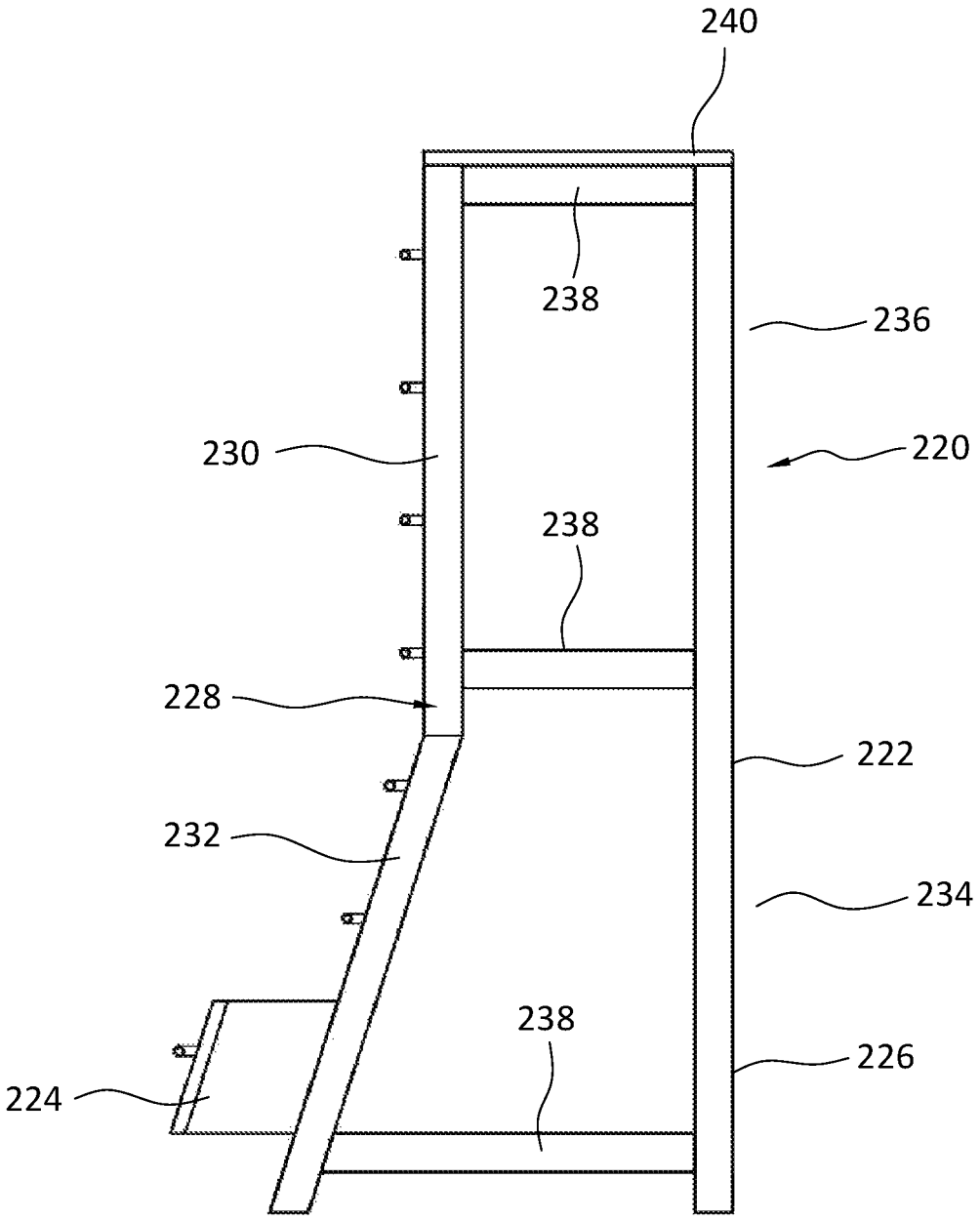
FIG. 36 is a side view of the dresser of FIG. 35.

FIGS. 35 and 36 show a first embodiment of a dresser 220 in accordance with the invention that provides for anti-tipping properties arising from its construction. For this embodiment of a dresser 220 and the following embodiments of dressers, the dressers may be made of various material and in various styles and designs. The essential aspect of the dressers is their shape, i.e., other than the traditional rectangular shape with all of the drawers having the same depth.

Dresser 220 includes a frame 222, a plurality of drawers 224, and hardware (not shown) to enable the drawers 224 to slide into and out of the frame 222 while being secured therein. The hardware is well-known to those skilled in the art.

The frame 222 includes two rear vertical supports 226, one on each side of the dresser 220, and two front vertical supports 228, one on each side of the dresser 220 and aligning with a respective one of the rear vertical supports 226. The rear vertical supports 226 are elongate and straight, preferably over their entire length. The front vertical supports 228 have two elongate sections 230, 232 with section 230 being above section 232. The entire left and right sides can be one panel as an alternative to vertical supports 226. There are many ways to design dressers and this is just one. What is important is the substantial shape configuration.

Section 230 is elongate and straight, preferably over its entire length, while section 232 is also elongate and straight, preferably over its entire length, but oriented at an acute angle to a longitudinal axis of section 230, and outward toward the front of the dresser 220. This acute angle may be anywhere from about 5 degrees to about 60 degrees. An optimum angle or angular range can be determined by considering the objectives of the invention, e.g., tipping prevention, and different dressers 220 can be made with different angles between the sections 230, 232.

As a result of the angular orientation of section 232 relative to section 230, a lower portion 234 of the dresser 220 is larger in the front-to-back direction than an upper portion 236 of the dresser 220 (the front-to-back direction being depth of the dresser 220). Lower portion 234 is that portion defined in part by section 232 of support 228 and a lower part of support 226 of (one set of supports 226, 228 being on each side of the dresser 220) and one or more horizontal supports 238 (one set on each side of the dresser 220). Upper portion 236 is that portion defined by section 230 of support 228 and an upper part of support 226 (one set of supports 226, 228 being on each side of the dresser 220) and one or more horizontal supports 238 (one set of each side of the dresser 220).

This larger lower portion 234 enables deeper drawers to be provided in the lower portion 234. The drawers 224 in the lower portion 224 have a gradually increasing depth from a smallest depth closest to the drawer(s) 224 in the upper portion 236 to a maximum depth in the lowermost drawer 224 in the dresser 220. The front panel of each of these drawers 224 in the lower portion 234 is preferably angled at an angle commensurate with the angular orientation of the section 232 (see FIG. 36).

Horizontal supports 238 include one support at the bottom of the dresser 220, one in a middle region of the dresser 220, slightly above the seam between the sections 230, 232 and one at the top of the dresser 10. A different number and position of horizontal supports 238 may be provided. The lowermost horizontal support may be a small distance above the lower edge of the vertical supports 226, 228 to enable a lower end region of the vertical supports 226, 228 to form legs for the dresser 220.

The frame 222 also includes an upper board 240, and may also include a lower board to define a support for the lowermost one of the drawers 224.

In dresser 220, the relationship with the top or upper portion 236 having substantially less depth than the depth of the base (part of lower portion 234) provides substantially increased tip-prevention than that of conventional dressers with a consistent depth in the front-to-back direction. With such conventional dressers, tipping is easily performed by simply reaching the top surface and pulling the dresser forward. Alternatively, the dresser may fall forward when the upper region drawers are filled with contents. Such condition will make tipping even easier. Another problem that can cause serious accidents would be for the toddler to climb into the bottom drawer with and without the upper region drawers containing heavy contents. All such conditions contribute to the myriads of annual accidents, injuries and even death.

The inventors realize that reaching the top forward back of dresser 220 configured as shown produces significant resistance, including grab area and stance to provide a significant level of safety and anti-tip-ability.

The invention typically sets the top and upper portion 236 back from the frontmost edge (of lower portion 234) causing a rearrangement of the center of gravity. The center of gravity is generally considered the point of an object at which the weight is evenly dispersed and all sides are in balance. By providing deeper drawers at the lower portion 234 of the dresser 220 relative to those in the upper portion 236, the center of gravity is caused to be closer to or in the lower portion 234 and such rearrangement of the center of gravity makes tipping of the dresser 220 more difficult.

In dresser 220, the upper region drawers are substantially less deep than those in the lower region 234 and the lower region 234 has, therefore, a deeper stance which invariably prevents the toddler 242 from engaging with enough force and stance to cause the dresser 220 to fall forward (see FIG. 35). In fact, this embodiment of dresser 220 will likely produce resistance for full grown adults, as well.

The relationship of the top to bottom depths of drawers 224 will produce desired results. For example, a dresser with a 16" deep top or upper board 240 and a 24" deep base will perform better than if the top was 24" (conventional designs), 20" (better), 18" (even better). Furthermore, by having the top further back than the bottom, the toddler 242 now has significantly more difficulty in grabbing the upper drawers (the drawers 224 in upper section 236) as well as the appropriate stance. Plus the distance of a four drawer conventional dresser is closer to the toddler, than a dresser of the same height, but whose top is set back. As such, the toddler 242 will need to reach all the way forward and be off balance and the result is that they would be able to exert less force and engagement. This configuration provides significant resistance to advance forward. Reach and pull is significantly diminished by toddlers, babies and children.

Figure 37:
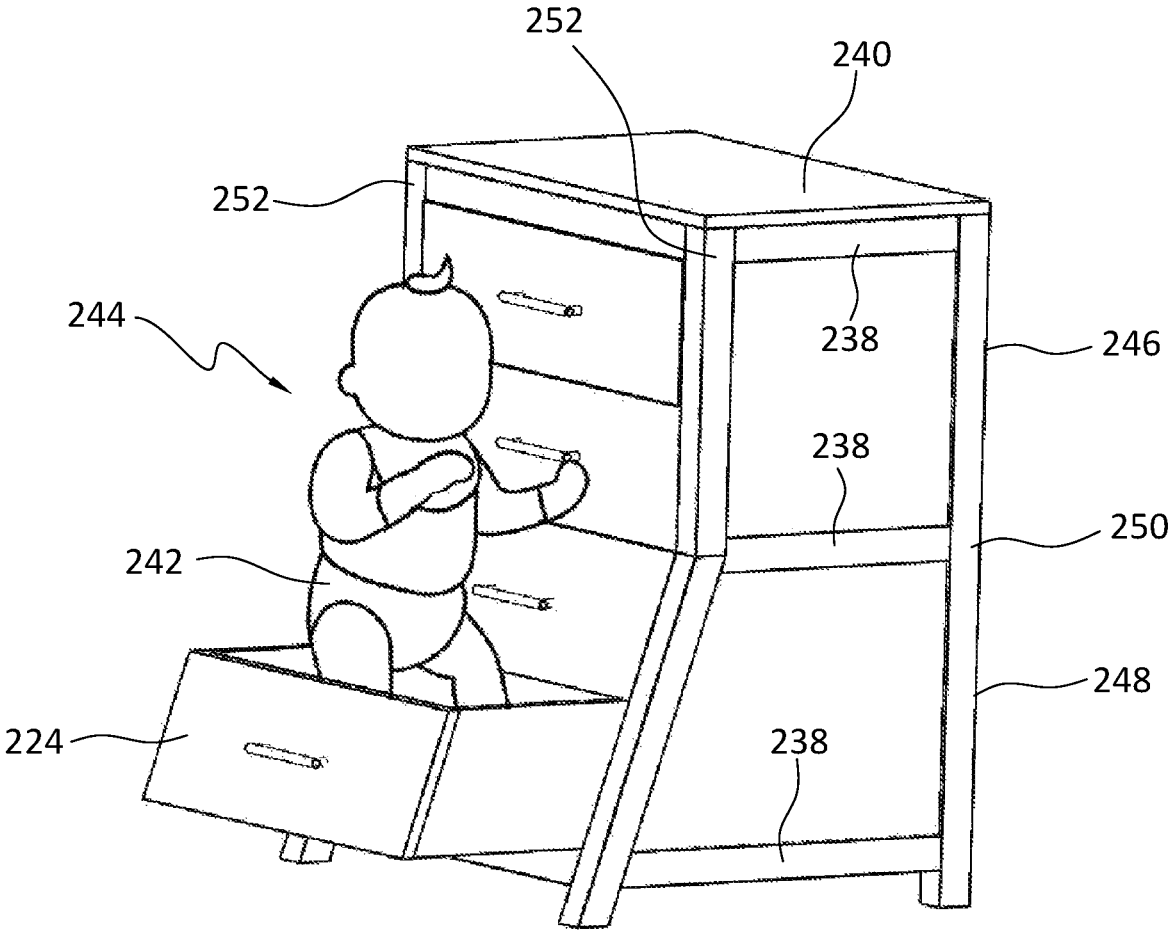
FIG. 37 is a perspective view of yet another embodiment of a dresser providing anti-tipping properties in accordance with the invention showing a toddler in one of the drawers, similar to the embodiment shown in FIG. 35.

Referring now to FIG. 37, this embodiment of a dresser 244 differs from the dresser 220 shown in FIGS. 35 and 36 in that instead of four drawers 224 in the upper portion 236 and three drawers 224 in the lower portion 234 of dresser 220, there only two drawers 224 in each of the upper section 246 and the lower section 248. The number of drawers 224 in the upper and lower sections of dresser 220 can thus vary to those as shown in FIG. 37 or any other numerical configuration.

The vertical supports 250, 252 in dresser 244 are similar to vertical supports 226, 228 in dresser 220, but dimensioned differently relative to the presence of only two drawers 224 in each of the upper and lower sections 246, 248. Thus, front vertical supports 250 have two sections, shorter than sections 230, 232, assuming the same height drawers 224 are provided in dresser 244 as in dresser 220. Otherwise, the components of dresser 244 are similar to those in dresser 220.

Figure 37A:
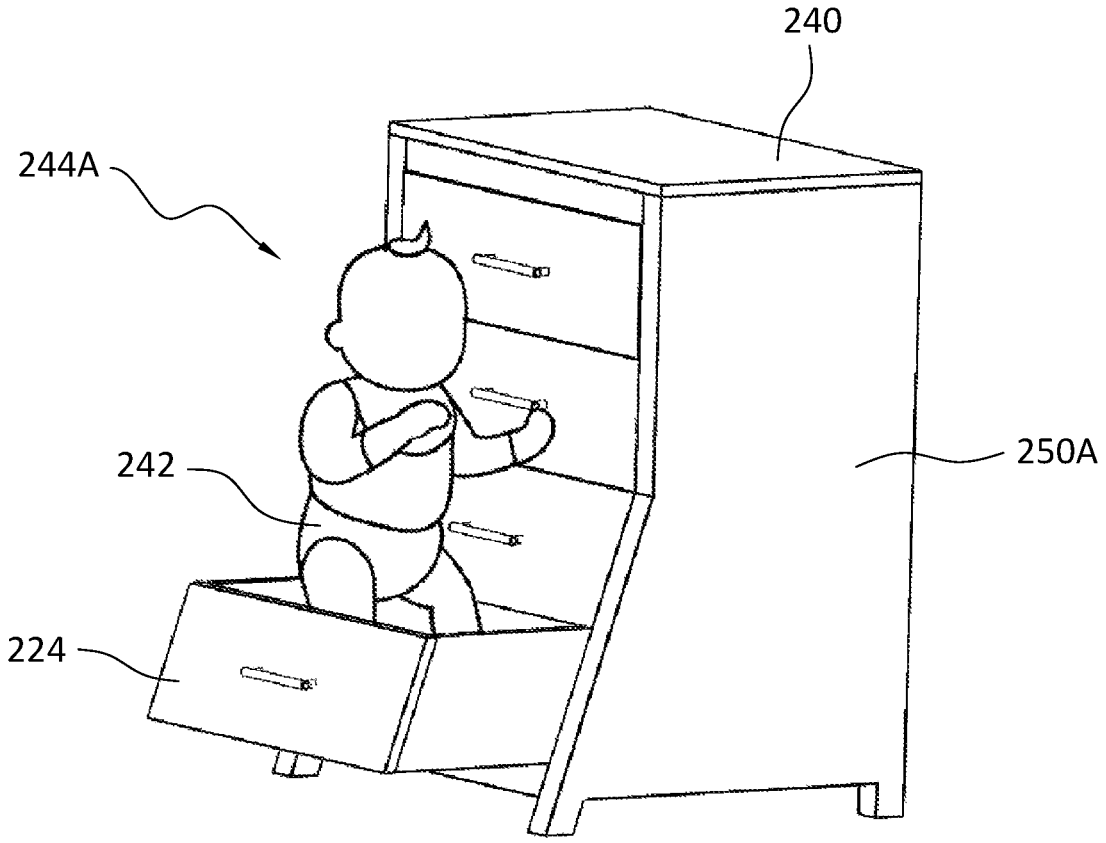
FIG. 37A is a perspective view of yet another embodiment of a dresser providing anti-tipping properties in accordance with the invention similar to the embodiment shown in FIG. 37 but with a different side panel.

In a variant shown in FIG. 37A, a dresser 244A can be designed with full panels on both sides, one such panel 250A being shown on the right side, and may not have vertical supports 250, 252 such as in this case. Such a design construction will function substantially the same as other dressers disclosed herein.

It should thus be apparent to those skilled in the art to which this invention pertains that the number of drawers and their height is variable. The basic construction of a dresser exemplified by the dressers 220, 244 is that the front vertical supports include two elongate sections. The profile of the side can in some embodiments, be one panel with the exact shape and dresser configurations. As such vertical supports 222, 230, 232, 252 238, 246, 248 etc. constitute just one such design. As shown in FIG. 37, a lower front vertical support extends forward and at an angle to an upper front vertical support to enable a lower portion of the dresser to have a larger front-to-back dimension, and a lower center of gravity than a dresser with only single depth drawers. The size of the two elongate sections is variable and depends on, for example, the desired height of the drawers and the number of drawers.

Figure 38:
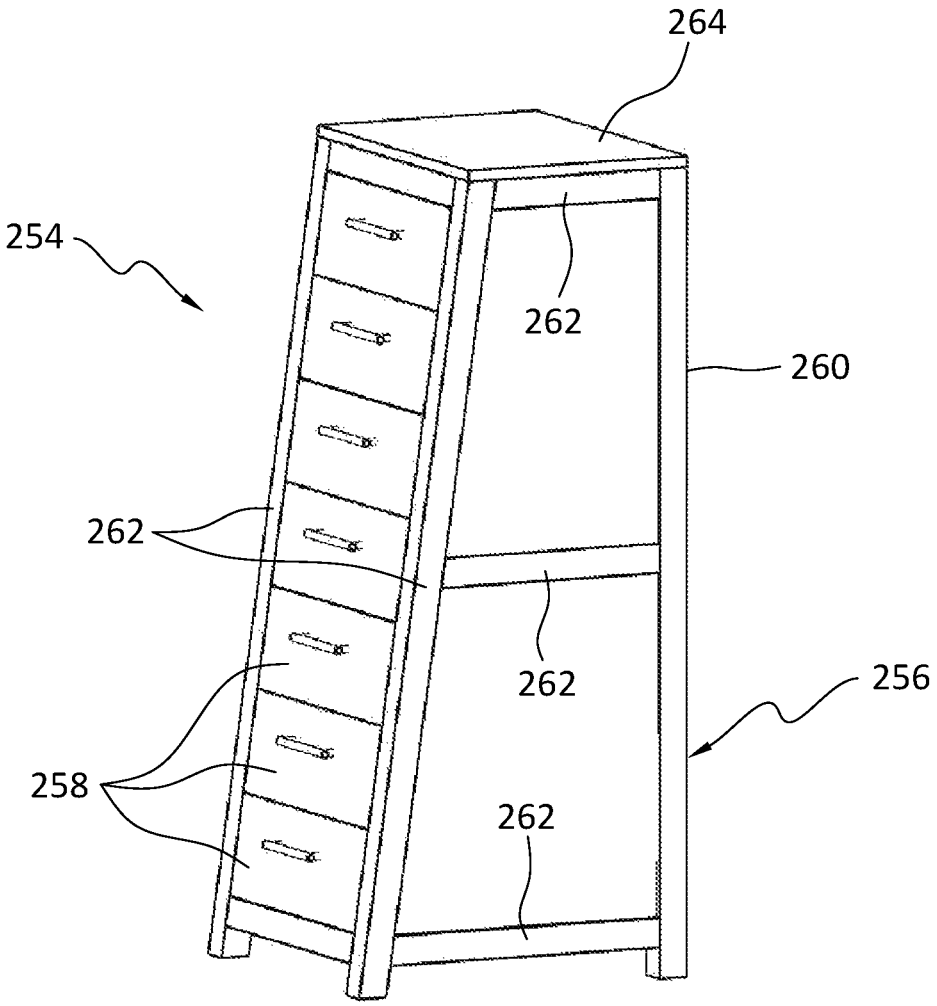
FIG. 38 is a perspective view of another embodiment of a dresser providing anti-tipping properties in accordance with the invention.
Figure 39:
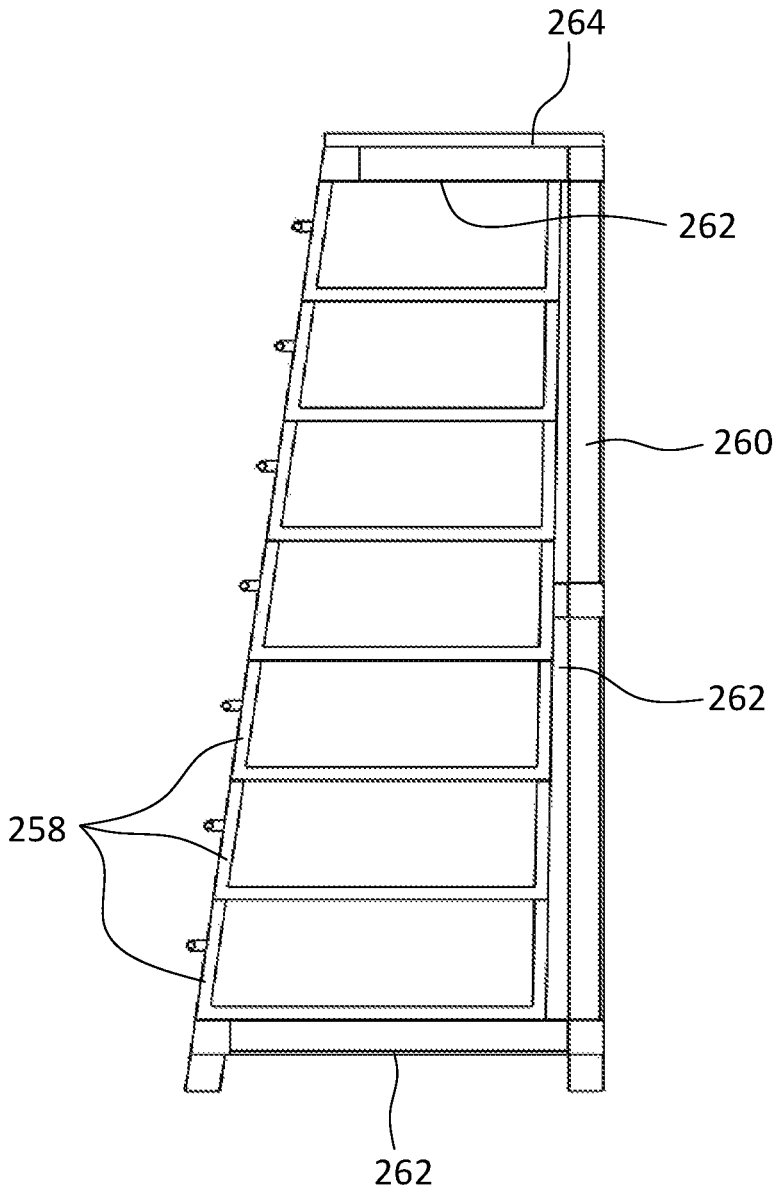
FIG. 39 is an internal, cross-sectional view of dresser shown in FIG. 38

FIGS. 38 and 39 show another embodiment of a dresser 254 integrating or incorporating anti-tipping properties in accordance with the invention includes a frame 256, a plurality of drawers 258, and hardware (not shown) to enable the drawers 258 to slide into and out of the frame 256 while being secured therein. The hardware is well-known to those skilled in the art.

The frame 256 includes two rear vertical supports 260, one on each side of the dresser 254, and two front vertical supports 262, one on each side of the dresser 254 and aligning with a respective one of the rear vertical supports 260. The rear vertical supports 260 are elongate and straight, preferably over their entire length. The front vertical supports 262 are also elongate and straight, preferably over their entire length, but oriented at an acute angle to a longitudinal axis of rear vertical supports 260, i.e., the longitudinal axis of the front vertical support 262 on each of the left and right sides of the dresser 254 intersects the longitudinal axis of the corresponding rear vertical support 260 on the left or right side of the dresser 254 at an acute angle. Supports 262 are also angled toward the front of the dresser 254.

This acute angle may be anywhere from about 5 degrees to about 60 degrees. An optimum angle or angular range can be determined by considering the objectives of the invention, e.g., tipping prevention, and different dressers 254 can be made with different angles between the rear vertical supports 260 and the front vertical supports 262.

As a result of the angular orientation of front vertical supports 262 relative to rear vertical supports 260, the front-to-back dimension of the dresser 254 increases in the downward direction from an upper board 264. As such, the drawers 258 have a gradually increasing depth when proceeding from the uppermost drawer 258 to the lowermost drawer 258 (see FIG. 39). The front panel of each drawer 258 may be angled at an angle commensurate with the angular orientation of the front vertical supports 262 (see FIG. 39).

Horizontal supports 266 include one support at the bottom of the dresser 254, one in a middle region of the dresser 254, and one at the top of the dresser 254. A different number and position of horizontal supports 266 may be provided. The lowermost horizontal support 266 may be a small distance above the lower edge of the rear and front vertical supports 260, 262 to enable a lower end region of the rear and front vertical supports 260, 262 to form legs for the dresser 254.

The frame 256 may also include a lower board to define a support for the lowermost one of the drawers 258.

When a child grabs the uppermost one of the drawers 258 when in an open state or stands on the lowermost one of the drawers 258 when in an open state, the child is unlikely to cause the dresser 254 to tip because of the lower center of gravity of the dresser 255 resulting from the larger drawers 258 at the bottom.

Figure 40:
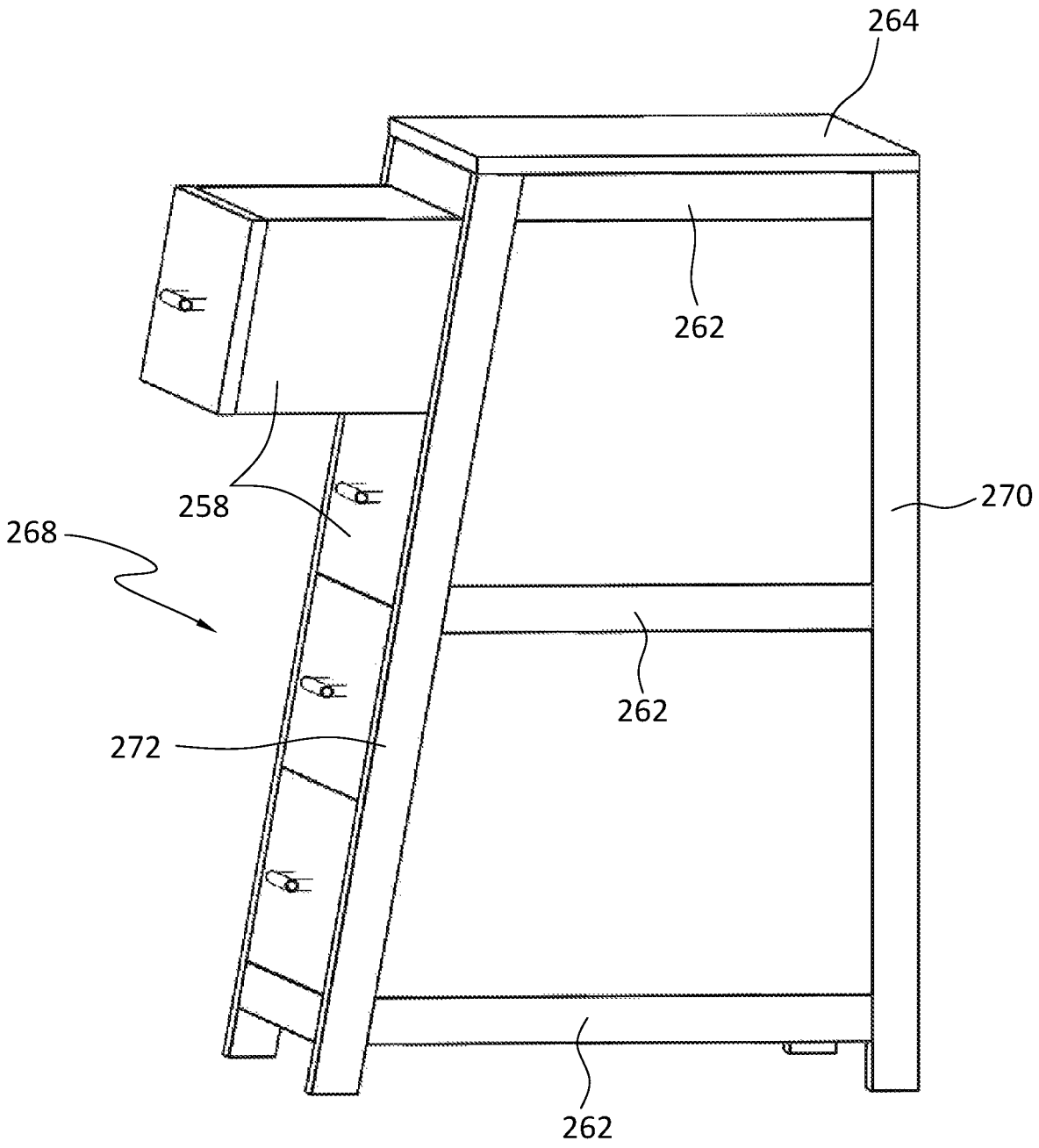
FIG. 40 is a perspective view of another embodiment of a dresser providing anti-tipping properties in accordance with the invention.

FIG. 40 shows an embodiment of a dresser 268 differs from the dresser 254 shown in FIGS. 38 and 39 in that instead of seven drawers 258, there only four drawers 258 of basically equal height resulting in a shorter dresser 268. The number of drawers 258 can thus vary to those as shown in FIGS. 38 and 39 or any other numerical configuration.

The vertical supports 270, 272 in the dresser 268 are similar to rear and front vertical supports 260, 262 in the dresser 254, but dimensioned differently relative to the presence of only four drawers 258. Other aspects of dresser 268 are the same as those of dresser 254, or possibly dressers 220, 244.

It should thus be apparent to those skilled in the art to which this invention pertains that the number of drawers in a dresser exhibiting anti-tipping properties and their height is variable. The basic construction of the dresser is that the front vertical supports are angled forward relative to the vertical rear supports to have an increasing front-to-back dimension in a direction downward from the upper board of the dresser, and thus a lower center of gravity than a dresser with only single depth drawers.

Figure 41:
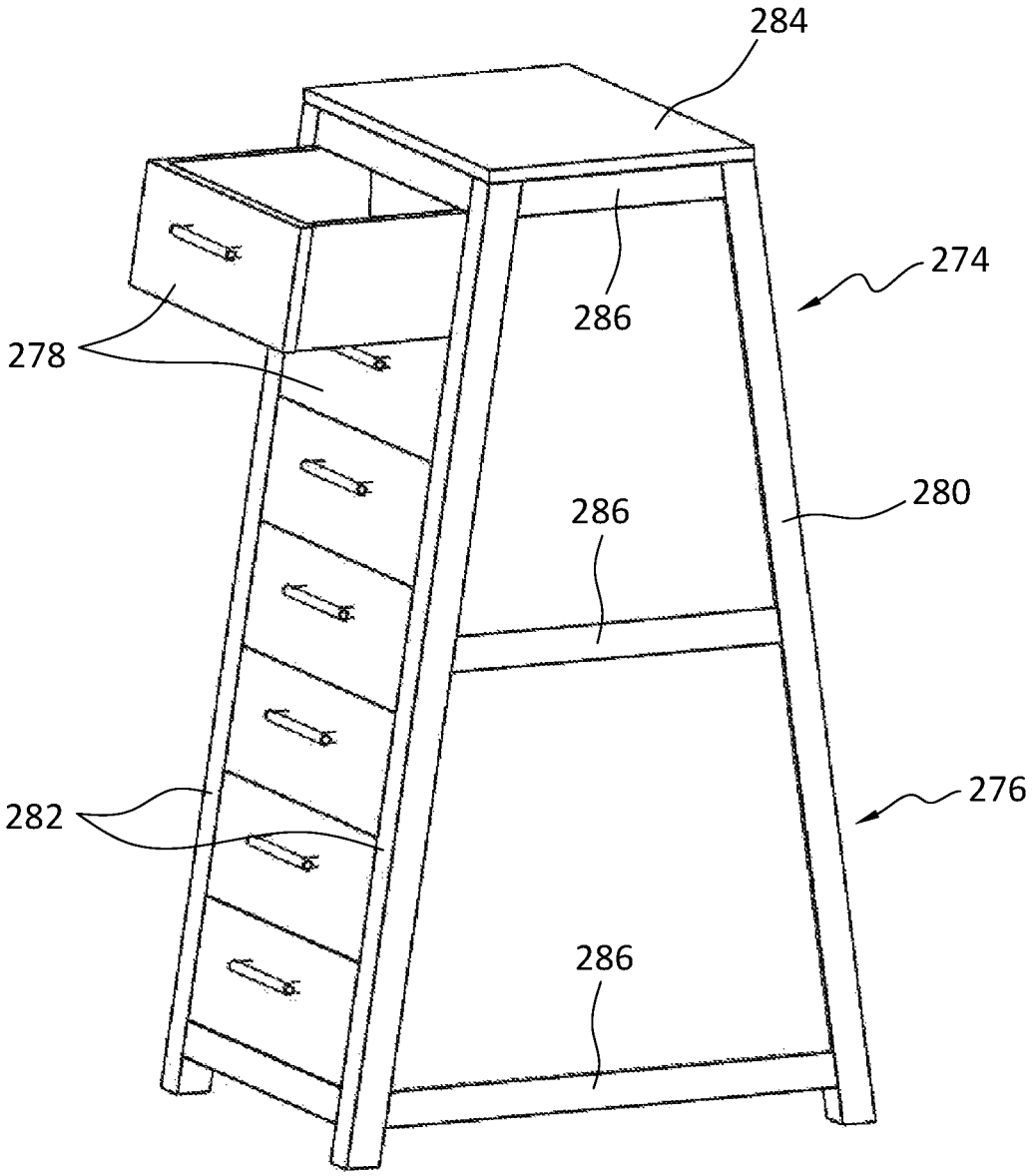
FIG. 41 is a perspective view of another embodiment of a dresser providing anti-tipping properties in accordance with the invention.

FIG. 41 shows another embodiment of a dresser 274 in accordance with the invention includes a frame 276, a plurality of drawers 278, and hardware (not shown) to enable the drawers 278 to slide into and out of the frame 276 while being secured therein. The hardware is well-known to those skilled in the art.

The frame 276 includes two rear vertical supports 280, one on each side of the dresser 274, and two front vertical supports 282, one on each side of the dresser 274 and aligning with a respective one of the rear vertical supports 280. Dresser 274 is similar to dresser 254 but has a significant difference.

Specifically, the rear vertical supports 280 are elongate and straight, preferably over their entire length, and oriented rearward and at an acute angle to a vertical axis of the dresser 274 that is perpendicular to the horizontal portions of the dresser 274, i.e., an upper board 284 and bottoms of the drawers 278. Similarly, the front vertical supports 282 are elongate and straight, preferably over their entire length, and oriented forward and at an acute angle to the same vertical axis of the dresser 274. As such, the rear and front vertical supports 280, 282 are angled toward the vertical axis of the dresser 274 and also toward one another. Neither longitudinal axis defined by the rear and front vertical supports 280, 282 is parallel to the vertical axis of the dresser 274.

These acute angles may be anywhere from about 5 degrees to about 60 degrees. An optimum angle or angular range can be determined by considering the objectives of the invention, e.g., tipping prevention, and different dressers 274 can be made with different angles between each of the rear and front vertical supports 280, 282 and the vertical axis of the dresser 274.

As a result of the angular orientation of rear and front vertical supports 280, 282 relative to the vertical axis of the dresser 274, the front-to-back dimension of the dresser 274 increases in the downward direction from the upper board 284. As such, the drawers 278 have a gradually increasing depth when proceeding from the uppermost one of the drawers 278 to the lowermost one of the drawers 278. The front panel of each drawer 278 may be angled at an angle commensurate with the angular orientation of the supports 282.

Horizontal supports 286 include one support at the bottom of the dresser 274, one in a middle region of the dresser 274, and one at the top of the dresser 274. A different number and position of horizontal supports 286 may be provided. The lowermost horizontal support 286 may be a small distance above the lower edge of the rear and front vertical supports 280, 282 to enable a lower end region of the vertical supports 280, 282 to form legs for the dresser 274.

The frame 276 may also include a lower board to define a support for the lowermost one of the drawers 278.

When a child grabs the uppermost one of the drawers 278 when in an open state or stands on the lowermost one of the drawers 278 when in an open state, the child is unlikely to cause the dresser 274 to tip because of the lower center of gravity of the dresser 274 resulting from the larger drawers at the bottom.

Figure 42:
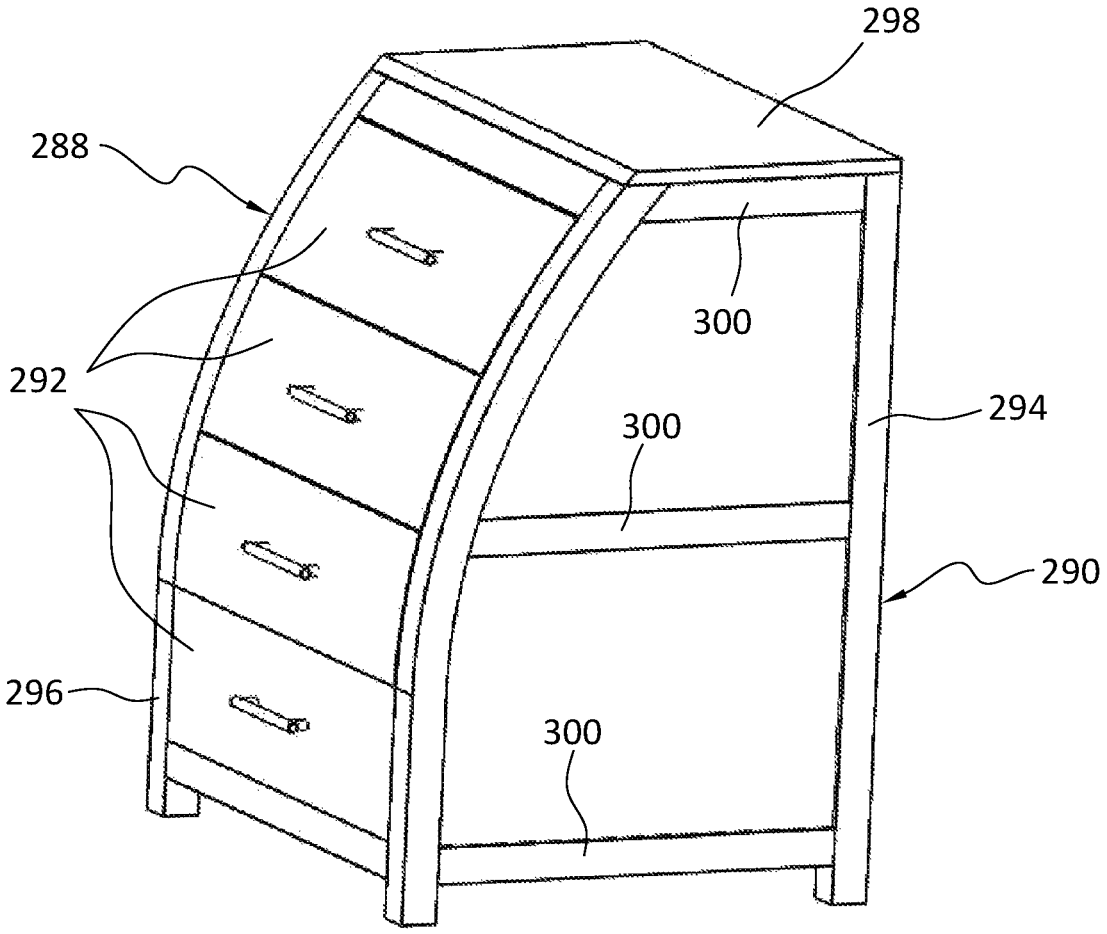
FIG. 42 is a perspective view of another embodiment of a dresser providing anti-tipping properties in accordance with the invention.

FIG. 42 shows an embodiment of a dresser 288 including a frame 290, a plurality of drawers 292, and hardware (not shown) to enable the drawers 292 to slide into and out of the frame 290 while being secured therein. The hardware is well-known to those skilled in the art.

The frame 290 includes two rear vertical supports 294, one on each side of the dresser 292, and two front vertical supports 296, one on each side of the dresser 292 and aligning with a respective one of the rear vertical supports 294. The rear vertical supports 294 are elongate and straight in the vertical direction, i.e., parallel to the vertical axis of the dresser 288, preferably along their entire length. The front vertical supports 296 are curved outward, i.e., they have a forwardly curved portion in the upper section of the dresser 288. An optimum forward curvature can be determined by considering the objectives of the invention, e.g., tipping prevention, and different dressers 288 can be made with different curvatures of the front vertical supports 296.

As a result of the curvature of at least a portion of the front vertical supports 296 relative to rear vertical supports 294, the front-to-back dimension of the dresser 288 increases in the downward direction from an upper board 298. A portion of the front vertical supports 296 may be elongate and straight, e.g., in the lower section as shown. With this configuration, the drawers 292 can have a gradually increasing depth when proceeding from the uppermost drawer 292 to the lowermost drawer 292. The front panel of each drawer 292 may be curved or angled at an angle commensurate with the angular or curvature orientation of the front vertical supports 296.

As shown, a lower part of the front vertical supports 296 may be straight and elongate while the remaining upper part is curved. Alternatively, the entire front vertical support 296 may be curved. The straight and elongate part, when present, may be the height of one drawer 292 as shown, or any number of drawers.

Horizontal supports 300 include one support at the bottom of the dresser 288, one in a middle region of the dresser 288, and one at the top of the dresser 288. A different number and position of horizontal supports 300 may be provided. The lowermost horizontal support 300 may be a small distance above the lower edge of the rear and front vertical supports 294, 296 to enable a lower end region of the rear and front vertical supports 294, 296 to form legs for the dresser 288.

The frame 290 may also include a lower board to define a support for the lowermost one of the drawers 292.

Dresser 288 therefore includes a protruding bulged curved front with drawers 292 protruding forward with the deep base footprint sweeping to the substantially less deep top which often is the key part that causes forward tipping by a toddler or a child 302. The bulge in the drawers 292 coupled with the difficult to reach top board 300 provides significant tip prevention.

The curved bulge arising from the curved vertical supports 296 serves to push the toddler forward somewhat thus making it more difficult to engage securely grasping the top. Furthermore, such imbalance and weaker footing by the toddler provides significantly improved anti tipping conditions. This is in-line with the overall embodiments where the base footprint is deeper than the top footprint thus providing a significantly positive secure stance and making tipping exceedingly difficult for the toddler (as well as their parent)

Figure 42A:
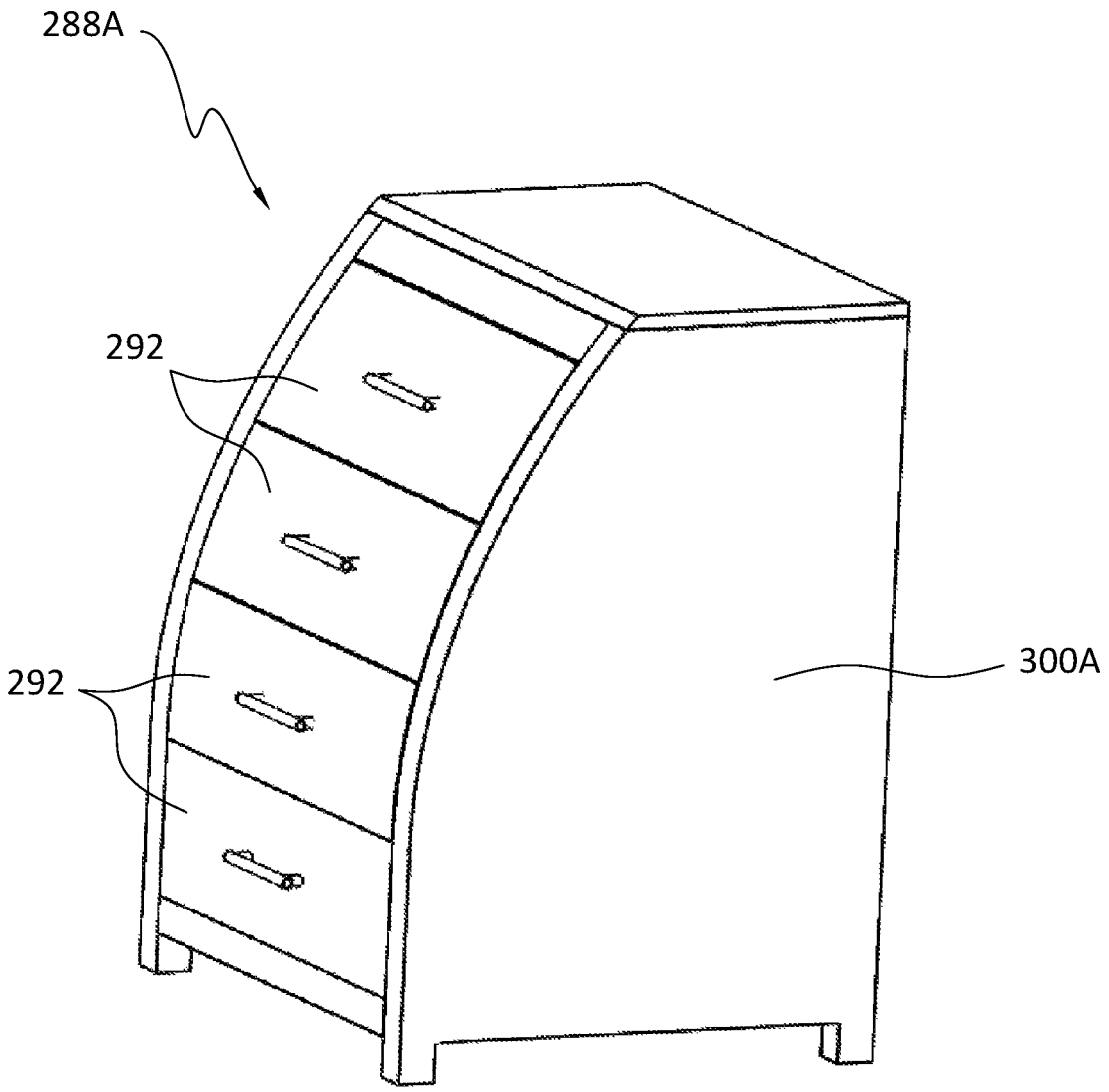
FIG. 42A is a perspective view of yet another embodiment of a dresser providing anti-tipping properties in accordance with the invention similar to the embodiment shown in FIG. 42 but with a different side panel.

In a variant shown in FIG. 42A, a dresser 288A can be designed with full panels on both sides, one such panel 300A being shown on the right side, and may not have vertical supports 294, 296 such as in dresser 288. Such a design construction will function substantially the same as other dressers disclosed herein.

Figure 42B:
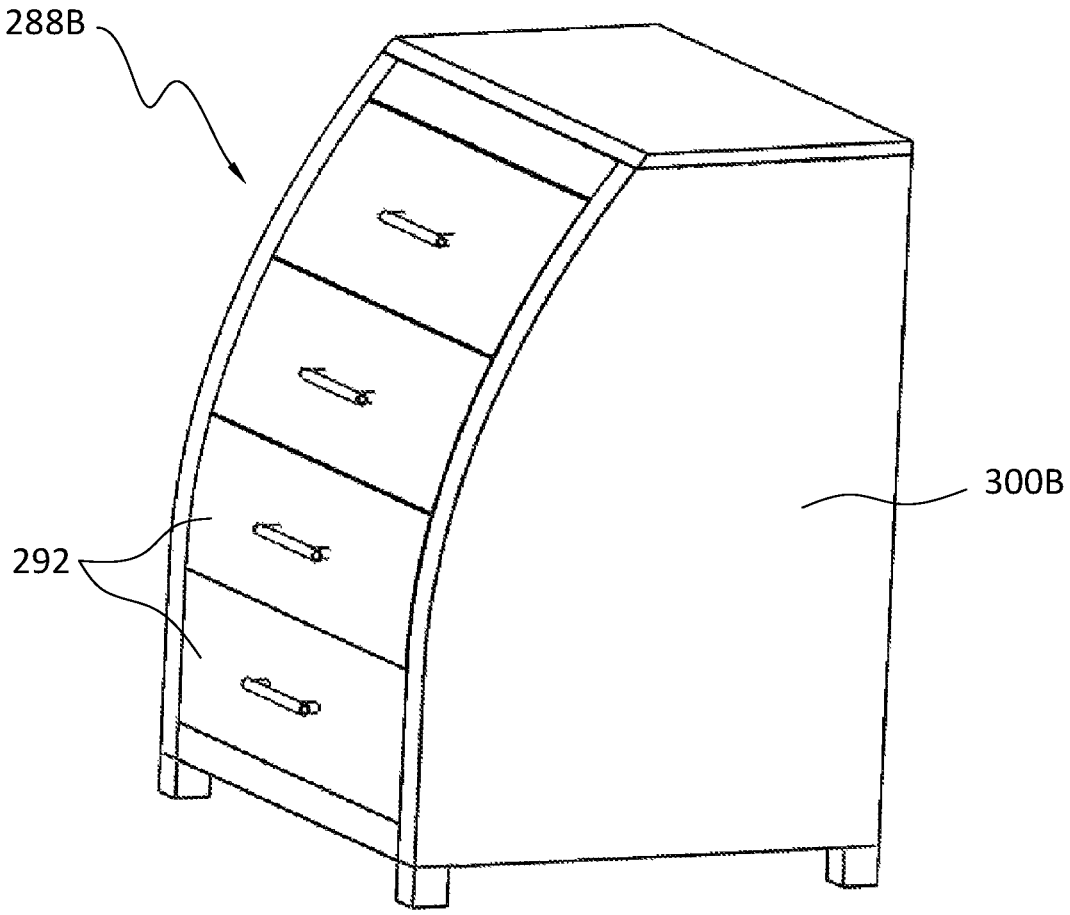
FIG. 42B is a perspective view of still another embodiment of a dresser providing anti-tipping properties in accordance with the invention similar to the embodiment shown in FIG. 42 but with a different side panel.

Similarly, in a variant shown in FIG. 42B, a dresser 288B can be designed with almost full panels on both sides, one such panel 300B being shown on the right side, The legs are not covered by or formed integral with the side panels. Vertical supports 294, 296, such as in dresser 288, may be eliminated. Such a design construction will function substantially the same as other dressers disclosed herein.

The dressers shown in FIGS. 35-42B may also include other anti-tipping mechanisms disclosed herein. For example, it is possible to put a post 62 as in the embodiments of FIGS. 12-15 on any of the dressers disclosed in FIG. 35-42B to improve the anti-tipping resistance.

While these embodiments are directed to the serious, often fatal, accidents involving toddlers, they address all anti-tipping furniture issues that may arise, involving both toddlers and adults.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A piece of furniture, comprising:

a frame, and at least one drawer movable into and at least partly out of said frame, each of said at least one drawer including a front panel which is a forwardmost, exposed surface of said drawer and the piece of furniture and moves together with a remaining portion of said drawer forward and backward between a first position in which an interior space of said drawer is inaccessible and a second position at least partly out of said frame in which the interior space of said drawer is accessible;

said frame including an upper section, a lower section having a greater front to back distance than said upper section, and legs that descend downward below a bottommost one of said at least one drawer such that when said frame is on a horizontal surface, said legs support a remaining portion of said frame above the horizontal surface with an open space therebetween, said frame further including two rear vertical supports that are elongate and straight between a top and bottom of said frame and two front vertical supports each aligning with a respective one of said rear vertical supports, each of said front vertical supports including a first elongate and straight section in said upper section adjoining the top of said frame and a second elongate and straight section in said lower section which is at an angle to said first section and extends from said first section to the bottom of said frame below said at least one drawer and adjoins the bottom of said frame, and whereby when said frame is on the horizontal surface and said at least one drawer is in the second position, tipping of said frame from its position on the horizontal surface as a result of downward pressure exerted on said at least one drawer is reduced by said lower section of said frame having the greater front to back distance than said upper section.

2. The furniture of claim 1, wherein said frame includes side panels that each extend over the entirety of a respective one of right and left sides of said frame and define front and rear ones of said legs.

3. The furniture of claim 1, wherein said frame includes side panels that each extend over the entirety of a respective one of right and left sides of said frame but not over front and rear ones of said legs of the furniture.

4. The furniture of claim 1, wherein one of said rear vertical supports is on each side of said frame, and one of said front vertical supports is on each side of said frame, said second section in said lower section being at an acute angle to a longitudinal axis of said first section and outward toward a front of the furniture.

5. The furniture of claim 4, wherein the acute angle is from about 5 degrees to about 60 degrees.

6. The furniture of claim 1, wherein said at least one drawer comprises a plurality of drawers one above another with at least one in said upper section and at least one other one in said lower section, said at least one of said drawers in said lower section having a larger depth than said at least one of said drawers in said upper section.

7. The furniture of claim 1, wherein said at least one drawer comprises a plurality of drawers in said lower section one above another and at least one drawer in said upper section above said plurality of drawers in said lower section, said drawers in said lower section having a gradually increasing depth from a smallest depth closest to said at least one drawer in said upper section to a maximum depth in a lowermost one of said plurality of drawers in said lower section.

8. The furniture of claim 7, wherein said plurality of drawers in said lower section have a common width and at least one of said plurality of drawers in said lower section includes a front panel angled at an angle commensurate with an angular orientation of said lower section.

9. The furniture of claim 1, wherein said frame further comprises horizontal supports on each side between said rear vertical supports and said front vertical supports and connecting said rear vertical supports and said front vertical supports.

10. The furniture of claim 9, wherein said horizontal supports include a first support at the bottom of said frame, a second support in a middle of said frame above a seam between said upper and lower sections, and a third support at the top of said frame.

11. The furniture of claim 10, wherein said third support is above a lower edge of said front and rear vertical supports such that a lower end region of said front and rear vertical supports form said legs of said frame.

12. A piece of furniture, comprising:

a frame, and a plurality of drawers movable into and at least partly out of said frame, said drawers being situated one above another, each of said drawers including a front panel which is a forwardmost, exposed surface of said drawer and the piece of furniture and moves together with a remaining portion of said drawer forward and backward between a first position in which an interior space of said drawer is inaccessible and a second position at least partly out of said frame in which the interior space of said drawer is accessible;

said frame including an upper section and a lower section having a greater front to back distance than said upper section, said frame further including two rear vertical supports that are elongate and straight between a top and bottom of said frame and two front vertical supports each aligning with a respective one of said rear vertical supports, each of said front vertical supports including a first elongate and straight section in said upper section adjoining the top of said frame and a second elongate and straight section in said lower section which is at an angle to said first section and extends from said first section to the bottom of said frame below said at least one drawer and adjoins the bottom of said frame, and at least one of said drawers being in said upper section and at least one other one of said drawers being in said lower section, said at least one of said drawers in said lower section having a larger depth than said at least one of said drawers in said upper section, and whereby when said frame is on a horizontal surface and any of said drawers is in the second position, tipping of said frame from its position on the horizontal surface as a result of downward pressure exerted on any of said drawers is reduced by said lower section of said frame having the greater front to back distance than said upper section.

13. The furniture of claim 12, wherein one of said rear vertical supports is on each side of said frame, and one of said front vertical supports is on each side of said frame, said second section in said lower section being at an acute angle to a longitudinal axis of said first section and outward toward a front of the furniture.

14. The furniture of claim 12, wherein said at least one of said drawers in said lower section comprises a plurality of drawers in said lower section partly between said second section of said front vertical supports, said drawers in said lower section having a gradually increasing depth from a smallest depth closest to said at least one drawer in said upper section to a maximum depth in a lowermost one of said plurality of drawers in said lower section.

15. A piece of furniture, comprising a frame, and a plurality of drawers movable into and at least partly out of said frame, said drawers being situated one above another, each of said drawers including a front panel which is a forwardmost, exposed surface of said drawer and the piece of furniture and moves together with a remaining portion of said drawer forward and backward between a first position in which an interior space of said drawer is inaccessible and a second position at least partly out of said frame in which the interior space of said drawer is accessible;

said frame including an upper section and a lower section having a greater front to back distance than said upper section, and at least one of said drawers being in said upper section and at least one other one of said drawers being in said lower section, said at least one of said drawers in said lower section having a larger depth than said at least one of said drawers in said upper section, whereby when said frame is on a horizontal surface and any of said drawers is in the second position, tipping of said frame from its position on the horizontal surface as a result of downward pressure exerted on any of said drawers is reduced by said lower section of said frame having the greater front to back distance than said upper section, and wherein said front panel of at least one of said drawers in said lower section is angled at an angle commensurate with an angular orientation of said lower section, said frame further comprises horizontal supports on each side between rear vertical supports and front vertical supports and connecting said rear vertical supports and said front vertical supports, said horizontal supports including a first support at the bottom of said frame, a second support in a middle of said frame above a seam between said upper and lower sections, and a third support at the top of said frame.

16. The furniture of claim 15, wherein said frame includes two rear vertical supports that are elongate and straight between a top and bottom of said frame and two front vertical supports each aligning with a respective one of said rear vertical supports, each of said front vertical supports including a first elongate and straight section in said upper section adjoining the top of said frame and a second elongate and straight section in said lower section which is at an angle to said first section and extends from said first section to the bottom of said frame below said at least one drawer in said lower section and adjoins the bottom of said frame.

17. The furniture of claim 15, wherein said frame includes two rear vertical supports that are elongate and straight between a top and bottom of said frame and two front vertical supports that are elongate and straight between the top and bottom of said frame and each aligning with a respective one of said rear vertical supports, said front vertical supports adjoining the bottom of said frame and being angled along their entire length forward.

18. The furniture of claim 15, wherein said frame includes two rear vertical supports that are elongate and straight and two front vertical supports that are elongate and straight and each aligning with a respective one of said rear vertical supports, said front vertical supports being angled along their entire length forward and said rear vertical supports being angled along their entire length rearward.

19. The furniture of claim 15, wherein said frame includes two rear vertical supports that are elongate and straight and two front vertical supports each aligning with a respective one of said rear vertical supports, each of said front vertical supports including a forwardly curved portion in said upper section.

20. The furniture of claim 15, wherein said plurality of drawers have a common width.

* * * * *